US006539189B2

(12) United States Patent
Yanagida

(10) Patent No.: US 6,539,189 B2
(45) Date of Patent: Mar. 25, 2003

(54) IMAGE BEARING MEMBER ROTATION CONTROL DEVICE, AND IMAGE FORMING APPARATUS AND METHOD USING THE IMAGE BEARING MEMBER ROTATION CONTROL DEVICE

(75) Inventor: Masato Yanagida, Meguro-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/903,501

(22) Filed: Jul. 13, 2001

(65) Prior Publication Data

US 2002/0034401 A1 Mar. 21, 2002

(30) Foreign Application Priority Data

Jul. 13, 2000 (JP) ..... 2000-212134
Dec. 25, 2000 (JP) ..... 2000-391992
Jun. 4, 2001 (JP) ..... 2001-167689

(51) Int. Cl.[7] ..... G03G 15/00
(52) U.S. Cl. ..... 399/167
(58) Field of Search ..... 399/159, 167, 399/36; 347/153, 154, 262, 264; 318/280, 362

(56) References Cited

U.S. PATENT DOCUMENTS 4,806,968 A * 2/1989 Watanabe et al. ..... 399/167
4,833,378 A * 5/1989 Furue et al. ..... 250/589
4,931,834 A * 6/1990 Suga ..... 399/75
4,967,239 A * 10/1990 Sakakura ..... 399/320
5,280,224 A * 1/1994 Sagara ..... 318/10
5,396,319 A 3/1995 Tokuhashi et al.
5,463,293 A * 10/1995 Matsui ..... 318/254
5,734,241 A * 3/1998 Okada et al. ..... 318/254

FOREIGN PATENT DOCUMENTS

JP 61-030976 A * 2/1986 ..... G03G/15/04
JP 62-127764 A * 6/1987 ..... G03G/15/00
JP 02118684 5/1990
JP 05035048 2/1993
JP 10105017 4/1998
JP 10254323 9/1998
JP 2001-013842 A * 1/2001 ..... G03G/15/16

* cited by examiner

*Primary Examiner*—Robert Beatty
(74) *Attorney, Agent, or Firm*—Oblon, Spivak, McClelland, Maier & Neustadt, P.C.

(57) ABSTRACT

A control device to control an image forming apparatus including a rotatable image bearing member, a transfer device that transfers a toner image from the image bearing member to a transfer material by applying a transfer bias, a cleaning device that removes a residual toner from the image bearing member by a cleaning blade, and an image bearing member drive motor that rotates in forward and reverse direction to drive the image bearing member to rotate. The control device controls the image bearing member drive motor to rotate in the reverse direction to brake the image bearing member and then rotate the image bearing member in the reverse direction time after controlling the transfer device to stop application of the transfer bias, and controls the image bearing member drive motor to stop rotating the image bearing member after the image bearing member starts rotating in the reverse direction.

70 Claims, 13 Drawing Sheets

IMAGE BEARING MEMBER ROTATION CONTROL DEVICE, AND IMAGE FORMING APPARATUS AND METHOD USING THE IMAGE BEARING MEMBER ROTATION CONTROL DEVICE

BACKGROUND OF THE INVENTION

1. Field of the Invention

The present invention relates to an electrophotographic image forming apparatus such as a copying machine, a printer, a facsimile, a multi-functional image forming apparatus, etc., and more particularly to an image bearing member rotation control device and method for controlling rotations of the image bearing member such as a photoreceptor and an intermediate transfer member used in the image forming apparatus.

2. Discussion of the Background

In an electrophotographic image forming apparatus, after a toner image formed on an image bearing member is transferred to a transfer material such as a transfer sheet and an intermediate transfer member, a cleaning device removes residual toner from the surface of the image bearing member for a next image forming operation.

One type of cleaning device employs a cleaning blade, and a leading edge of the cleaning blade is press-contacted against a surface of an image bearing member to remove toner remaining on the image bearing member.

In such a cleaning device, the friction between the cleaning blade and the image bearing member changes depending on a contact condition therebetween. When the friction between the cleaning blade and the image bearing member is high, resonance noise may occur between the leading edge of the cleaning blade and the image bearing member. Even though the resonance noise does not occur when the image bearing member rotates at a process speed in an image forming operation, the resonance noise is likely to occur when the image bearing member rotates at a low speed immediately before its rotation stops.

The above-described resonance noise produced between the leading edge of the cleaning blade and the image bearing member before the rotation stops of the image bearing member may be referred to as "blade noise" hereinafter.

In a background image forming apparatus employing an image forming process cartridge including a photoreceptor and a cleaning blade, a control material is attached to an inner wall of the photoreceptor to prevent the occurrence of resonance noise between the photoreceptor and the cleaning blade.

In another background image forming apparatus employing an image forming process cartridge including a photoreceptor and a charging roller, the photoreceptor includes a substance having a specific gravity of 0.5 or greater to prevent a vibration caused by elastic deformation of the photoreceptor and the charging roller. As a result of preventing the vibration of the photoreceptor and the charging roller, noise due to the vibration is avoided.

In the above-described both background image forming apparatuses, because the photoreceptor is often replaced based on the number of image forming operations, the total cost of a number of photoreceptors is increased by such a control material or a substance having a specific gravity of 0.5 or greater. In addition, when an image forming apparatus employs a relatively large sized photoreceptor, the size of the control material is required to be increased. Consequently, the cost of the photoreceptor increases.

Further, in the image forming apparatus with the photoreceptor including the substance having a specific gravity of 0.5 or greater, the photoreceptor is always in a braking condition. In such a braking condition, wear of a transmission gear for driving the photoreceptor may be accelerated.

Another background image forming apparatus which prevents the occurrence of blade noise is described referring to FIG. 13. FIG. 13 is a view of a relationship between a number of revolutions (rpm) of a photoreceptor and a time until the rotation of the photoreceptor stops. As illustrated in FIG. 13, in a period between a number of revolutions "b" (rpm) and a number of revolutions "zero", a blade noise is likely to occur.

As illustrated in FIG. 13, after an image forming operation is completed, a current fed to a photoreceptor drive motor, which drives the photoreceptor to rotate, is stopped. Thereafter, the photoreceptor rotates by inertia. When the number of revolutions (rpm) of the photoreceptor is decreased from the number of revolutions "a" (rpm) to substantially the number of revolutions "b" (rpm) at which the blade noise is likely to occur, the brake is put on the photoreceptor to stop the rotation of the photoreceptor as indicated by the dotted line in FIG. 13.

When compared to a case in which a photoreceptor stops rotating by inertia (indicated by a solid line in FIG. 13), a rotation time of the photoreceptor in a period between the number of revolutions "b" (rpm) and the number of revolutions "zero" is reduced from "Ta" (seconds) to "Tb" (seconds). As a result, the occurrence of the blade noise is prevented.

However, an image forming apparatus including a photoreceptor and a cleaning blade has another problem to be solved. Specifically, a foreign substance such as paper powder may attach to a leading edge of the cleaning blade, which thereby causes the useful lifetime of the cleaning blade to be decreased.

Referring again to FIG. 13, in order to remove such a foreign substance from the leading edge of the cleaning blade, the above-described background image forming apparatus controls the photoreceptor to rotate in a reverse direction for a predetermined time after the rotation of the photoreceptor is stopped. In the operations of the above-described background image forming apparatus, the operations for preventing the occurrence of the blade noise and for removing the foreign substance from the leading edge of the cleaning blade are separately performed.

SUMMARY OF THE INVENTION

The present inventors have recognized that an image forming apparatus which efficiently prevents occurrence of blade noise and removes a foreign substance from a leading edge of a cleaning blade at substantially the same time is heretofore not known in the art.

Accordingly, one object of the present invention is to address the above and other problems in the background art.

According to one aspect of the present invention, a control device to control an image forming apparatus includes a rotatable image bearing member configured to bear a toner image. A transfer device is configured to transfer the toner image from the image bearing member to a transfer material by applying a transfer bias to the transfer material. A cleaning device is configured to remove residual toner from the image bearing member by a cleaning blade. And, an image bearing member drive motor is configured to rotate in a forward direction and a reverse direction to drive the image bearing member to rotate in a forward direction and a reverse direction. The control device is configured to control the image bearing member drive motor to rotate in the reverse direction to brake the image bearing member and then rotate the image bearing member in the reverse direction after controlling the transfer device to stop application of the transfer bias, and to control the image bearing member drive motor to stop rotating the image bearing member after the image bearing member starts rotating in the reverse direction.

According to another aspect of the present invention, a method of forming an image in an image forming apparatus includes rotating an image bearing member to form an image thereupon, applying a transfer bias to a transfer material to transfer a toner image on the image bearing member to the transfer material, controlling an image bearing member drive motor to rotate in a reverse direction to brake the image bearing member and then rotate the image bearing member in the reverse direction after controlling a transfer device to stop application of the transfer bias, and to stop rotating the image bearing member after the image bearing member starts rotating in the reverse direction.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
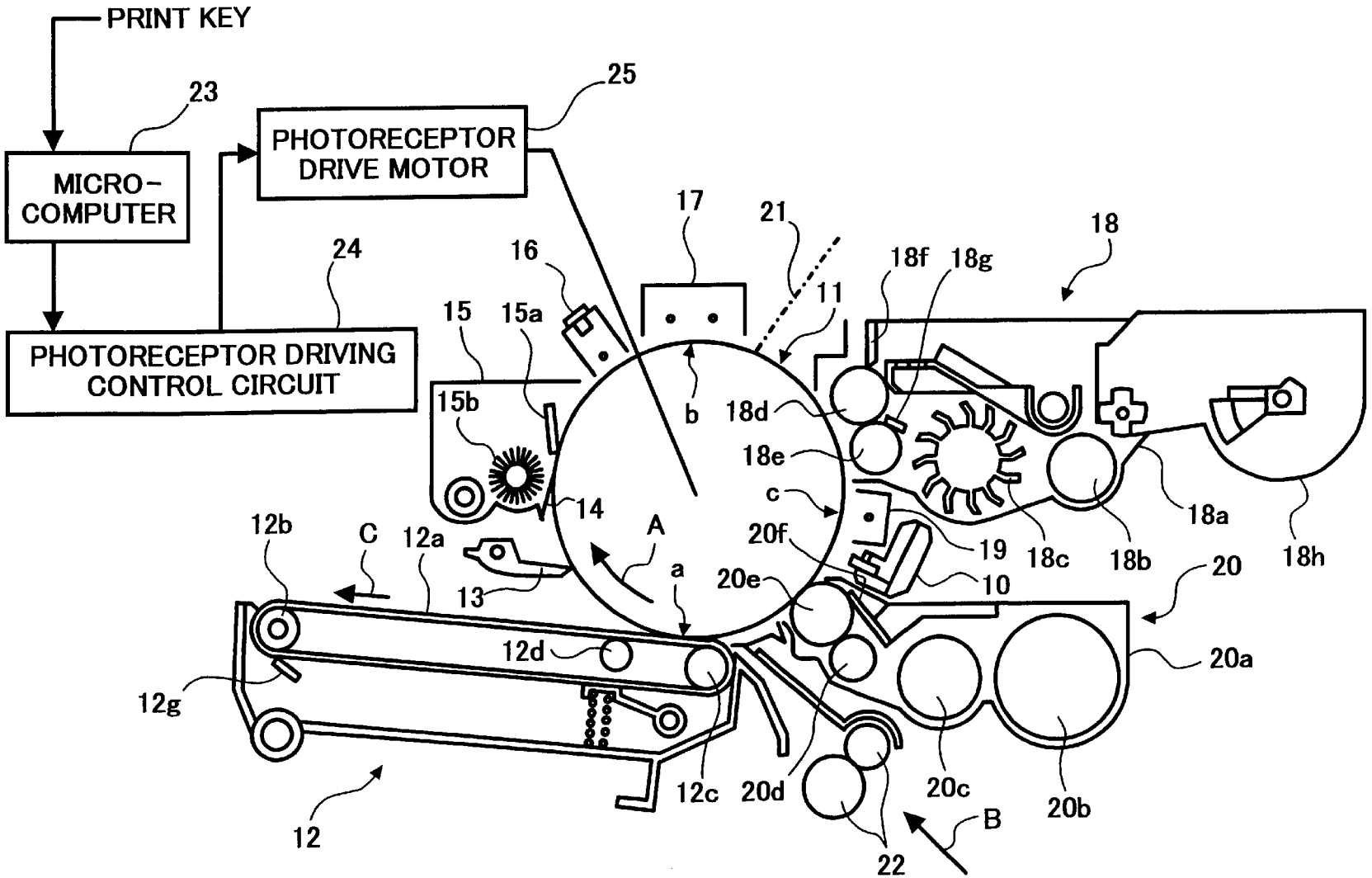
FIG. 1 is a schematic view of a two-color copier to which the present invention is applied.

Preferred embodiments of the present invention are described in detail referring to the drawings, wherein like reference numerals designate identical or corresponding parts throughout the several views.

FIG. 1 is a schematic view of a two-color copier to which the present invention is applied. The present invention can be applied not only to a copier, but also to similar image forming apparatuses such as a printer, a facsimile, etc. Further, the present invention can be applied not only to a two-color image forming apparatus, but also to a full-color image forming apparatus, a single-color image forming apparatus, etc.

The two-color copier of FIG. 1 includes a color scanner (not shown) at an upper part of a main body of the copier to scan an original document (not shown). Further, an auto document feeder (not shown, hereinafter referred to as an ADF) and a sorter (not shown) are attachable to the main body of the copier.

In the two-color copier, the color scanner illuminates an original document to form an image of the original document. The color scanner further separates colors of light into two colors, e.g. black and red, and converts each of the separated colors into electric digital image signals.

The ADF sequentially feeds original documents onto an original document setting table of the color scanner for scanning the original document by the color scanner. After the completion of scanning, the ADF discharges the original document from the original document setting table of the color scanner.

Each of the electric digital image signals for black and red as image data undergoes a predetermined process at an image processing unit, and is then sent to a first laser writing device (not shown) and a second laser writing device 10.

Referring. to FIG. 1, in an image forming unit, an OPC photoreceptor drum 11 (hereinafter referred to as a photoreceptor 11) is employed as an image bearing member. Arranged around the photoreceptor 11 are a first charging device 17, the first laser writing device (not shown), a first developing device 18, a second charging device 19, the second laser writing device 10, a second developing device 20, a transfer device 12, a separation pick 13, a photoreceptor cleaning device (i.e., an image bearing member cleaning device) 15, and a discharging device 16 in the order of the rotational direction of the photoreceptor 11 as indicated by arrow A.

In the first developing device 18, in the context of the example noted above, a developer container 18*a* contains a color two-component developer including black toner and carrier. In the second developing device 20, a developer container 20*a* contains a color two-component developer including red toner and carrier.

The first charging device 17, the first laser writing device (not shown), the second charging device 19, and the second laser writing device 10 constitute a latent image forming device forming a latent image on the photoreceptor 11.

Further, the above-described latent image forming device, the first developing device 18, and the second developing device 20 constitute a toner image forming device forming a toner image on the photoreceptor 11.

A user sets a color original document on the original document setting table of the color scanner by hand or by using the ADF. Then, the user selects a sheet size on an operation unit (not shown) and turns on a print key of the operation unit, thereby starting a copying operation. Upon starting the copying operation, the color scanner scans a color original document set on the original document setting table by colors, and converts each of the separated colors (black and red) into electric digital image signals.

In the image forming unit, the photoreceptor 11 is driven to rotate in a direction indicated by arrow A by a photoreceptor drive motor (i.e., an image bearing member drive motor) 25. A driving force is transmitted from the photoreceptor drive motor 25 to the photoreceptor 11 via a driving force transmitting mechanism such as gears.

While rotating the photoreceptor 11, the surface of the photoreceptor 11 is uniformly charged by the first charging device 17 at a first charging position "b" illustrated in FIG. 1. Then, the surface of the photoreceptor 11 is irradiated with a laser beam 21 emitted from the first laser writing device in accordance with a black digital image signal sent from the image processing unit. As a result, an electrostatic latent image corresponding to a black component of the color image of the original document is formed on the photoreceptor 11, and then passes the position of the first developing device 18.

In the first developing device 18, a two-component developer including black toner and carrier contained in the developer container 18*a* is agitated by agitators 18*b* and 18*c* and is then supplied to developing rollers 18*d* and 18*e*. The developing rollers 18*d* and 18*e* magnetically attract the developer while rotating and carry their developer on the surfaces thereof.

The developer carried on the surfaces of the developing rollers 18*d* and 18*e* is regulated to a predetermined thickness by doctor blades 18*f* and 18*g*. While the developer passes through a gap between the developing rollers 18*d*/18*e* and the photoreceptor 11, black toner is transferred to the photoreceptor 11, and thereby a latent image on the photoreceptor 11 is developed with black toner. As a result, a black toner image is formed on the surface of the photoreceptor 11.

A toner replenishing device 18*h* replenishes the developer contained in the developer container 18*a* with black toner. The agitators 18*b* and 18*c* are driven to rotate by a driving unit (not shown). The developing rollers 18*d* and 18*e* are connected to a driving unit (not shown) by a clutch to be driven to rotate.

Further, after passing the position of the first developing device 18, the surface of the photoreceptor 11 is uniformly charged with the second charging device 19 at a second charging position "c" illustrated in FIG. 1. Then, the surface of the photoreceptor 11 is irradiated with a laser beam emitted from the second laser-writing device 10 in accordance with a red digital image signal sent from the image processing unit. Thereby, an electrostatic latent image corresponding to a red component of the color image of the original document is formed on the photoreceptor 11 such that the electrostatic latent image corresponding to the red component is superimposed on the above-described black toner image. Thereafter, the second developing device 20 develops the electrostatic latent image with red toner, thereby forming a red toner image. As a result, a two-color image composed of black and red toner images is formed on the photoreceptor 11.

In the second developing device 20, a two-component developer including red toner and carrier is agitated by agitators 20*b* and 20*c* and is conveyed to a developer supplying roller 20*d*. Then, the developer is supplied to a developing roller 20*e* by the developer supplying roller 20*d*. The developing roller 20*e* magnetically attracts the developer while rotating and carries the developer on its surface thereof.

The developer carried on the surface of the developing roller 20*e* is regulated to a predetermined thickness by a doctor blade 20*f*. While the developer passes through a gap between the developing roller 20*e* and the photoreceptor 11, red toner is transferred to the photoreceptor 11, and thereby an electrostatic latent image on the photoreceptor 11 is developed with red toner. As a result, a red toner image is formed on the surface of the photoreceptor 11. The agitators 20*b* and 20*c*, the developer supplying roller 20*d*, and the developing roller 20*e* are driven to rotate by a driving unit (not shown).

A transfer material, such as a transfer sheet, an overhead transparency film of a sheet size selected by a user on the operation unit, etc., is fed from a sheet feeding cassette (not shown) to a pair of registration rollers 22 in a direction indicated by arrow B in FIG. 1. The registration rollers 22 feed the transfer material to a transfer position "a" between the photoreceptor 11 and the transfer device 12 at a timing such that a leading edge of the two-color toner image on the photoreceptor 11 is aligned with a leading edge of the transfer material.

The transfer device 12 employs an endless transfer belt 12*a*. The transfer belt 12*a* is spanned around a driving roller 12*b*, a driven roller 12*c*, and a bias roller 12*d*. The driving roller 12*b* is driven to rotate by a driving unit (not shown), and thereby the transfer belt 12*a* is rotated.

The transfer belt 12*a* contacts or separates from the photoreceptor 11 by a belt contact/separate mechanism (not shown). At the time of transferring a two-color toner image from the photoreceptor 11 to the transfer belt 12*a*, the transfer belt 12*a* is press-contacted to the photoreceptor 11. At other times, the transfer belt 12*a* is away from the photoreceptor 11.

A high voltage power supply serving as a charge applying device applies a charge to the transfer belt 12*a* at the time of the transferring by applying a transfer bias to the transfer belt 12*a* via a bias roller 12*d* serving as a transfer electrode. The transfer belt 12*a* conveys the transfer material fed from the registration rollers 22. After the two-color toner image on the photoreceptor 11 is electrostatically transferred to the transfer material at the transfer position "a" by applying the transfer bias to the transfer belt 12*a*, the transfer material is separated from the photoreceptor 11 and is conveyed in a direction indicated by arrow C in FIG. 1. When the transfer material is not separated from the photoreceptor 11, the separation pick 13 separates the transfer material from the photoreceptor 11. The separated transfer material is conveyed by the transfer belt 12*a*.

The transfer material separated from the photoreceptor 11 is further separated from the transfer belt 12*a* at the position of the driving roller 12*b*. Thereafter, the toner image carried on the transfer material is fixed thereon by a fixing device (not shown). The transfer material with the fixed toner image is discharged from the main body of the copier by discharging rollers (not shown).

After the surface of the photoreceptor 11 passes the separation pick 13, the photoreceptor cleaning device 15 removes toner remaining on the photoreceptor 11 by a cleaning blade 15*a* made of, for example, an elastic member of polyurethane rubber, and by a cleaning brush 15*b*.

Subsequently, the surface of the photoreceptor 11 is discharged by the discharging device 16.

A seal member 14 such as a mylar (trade mark) can be provided at the entrance of the photoreceptor cleaning device 15. The leading edge of the seal member 14 is made to contact the photoreceptor 11 to prevent the removed toner from leaking from the photoreceptor cleaning device 15.

A transfer belt cleaning device (not shown) that cleans the transfer belt 12*a* includes a cleaning blade 12*g* made of an elastic member. The cleaning blade 12*g* is provided at a position downstream of the transfer material separating position where the transfer material is separated from the transfer belt 12*a* in the rotational direction of the transfer belt 12*a* to remove residual toner from the transfer belt 12*a*.

The above-described copying operation starts upon turning on (pressing) a print key, and is consecutively repeated a predetermined number of times in accordance with a number of copy sheets set by a user on the operation unit. When a single-color (i.e., black) copy mode is selected on the operation unit, only a black toner image is formed on the photoreceptor 11 without operating the second charging device 19, the second laser writing device 10, and the second developing device 20. In this case, the color scanner scans a black component of a color image of an original document set on the original document setting table of the color scanner. The color scanner further converts the scanned black component into electric digital image signals. As a result, a single-color (black) copy is obtained.

Figure 2:
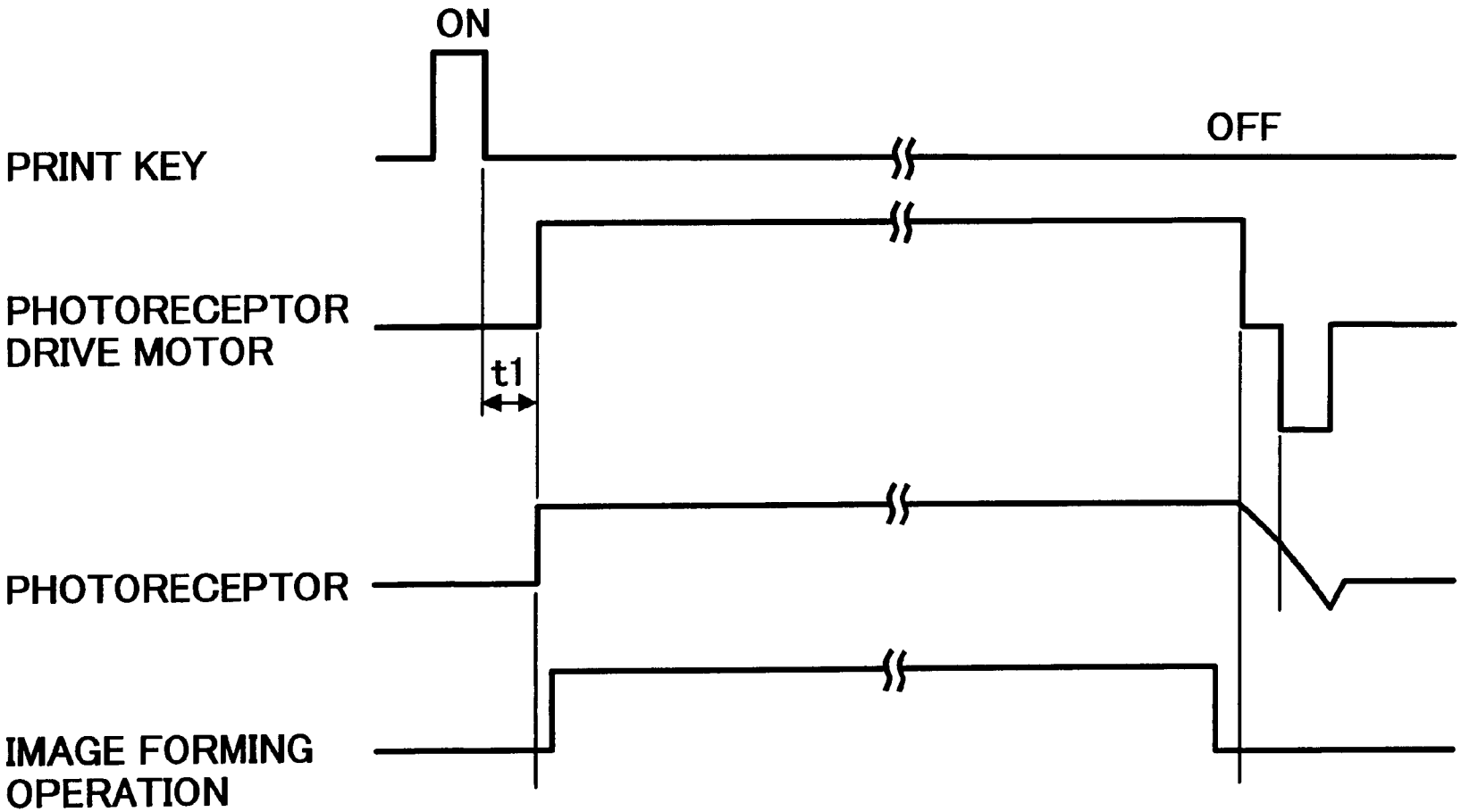
FIG. 2 is a timing chart of operations of the copier of FIG. 1.

The above-described copier includes a microcomputer 23 serving as a control device. When the print key is turned on, a print signal is input to the microcomputer 23. When a predetermined time "t1" elapses after the print signal is input to the microcomputer 23, the microcomputer 23 inputs an instruction for starting rotation of the photoreceptor 11 to a photoreceptor driving control circuit 24. After the instruction for rotating the photoreceptor 11 is input to the photoreceptor driving control circuit 24, the photoreceptor driving control circuit 24 generates a drive signal to drive a photoreceptor drive motor 25, and thereby the photoreceptor 11 is driven to rotate. FIG. 2 is a timing chart of the above-described operations of the copier.

The microcomputer 23 controls image forming operations of each unit of the copier. After the image forming operations are completed, the microcomputer 23 inputs an instruction for stopping the rotation of the photoreceptor 11 to the photoreceptor driving control circuit 24. The photoreceptor driving control circuit 24 controls the photoreceptor drive motor 25 to stop according to the instruction of the microcomputer 23. After the photoreceptor drive motor 25 stops, the photoreceptor 11 rotates by inertia.

Figure 3:
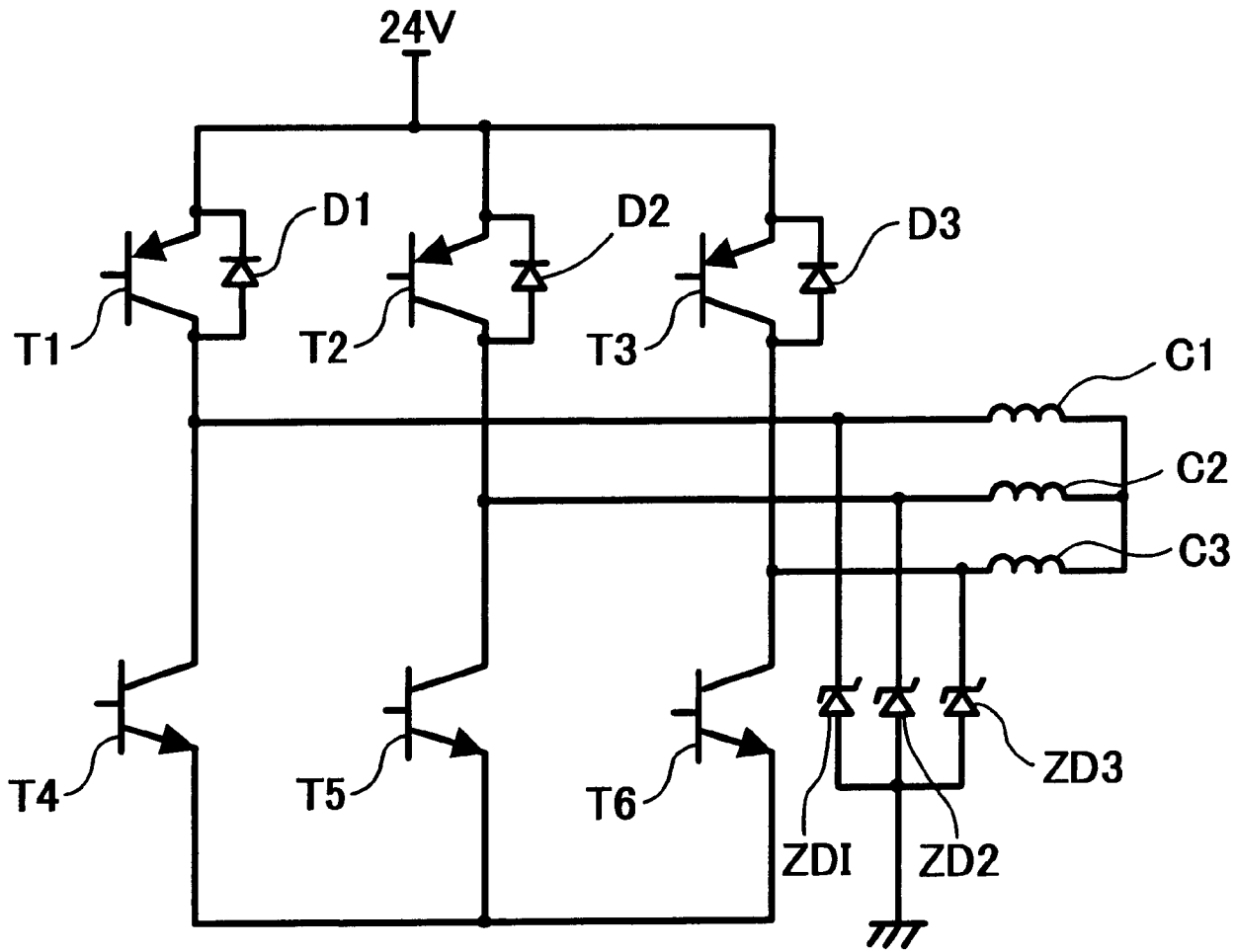
FIG. 3 is a circuit diagram of a part of a photoreceptor driving control circuit of the copier of FIG. 1.

FIG. 3 is a circuit diagram of a part of the photoreceptor driving control circuit 24. The photoreceptor driving control circuit 24 includes transistors T1 through T6, diodes D1 through D3, and Zener diodes ZD1 through ZD3. The photoreceptor driving control circuit 24 controls supply of drive current to coils C1 through C3 of the photoreceptor drive motor 25 by turning on and off the transistors T1 through T6 in accordance with the instruction of the microcomputer 23, thereby driving the photoreceptor drive motor 25.

When the photoreceptor driving control circuit 24 controls the photoreceptor drive motor 25 to rotate, the photoreceptor driving control circuit 24 repeats the following control operations of the transistors T1 through T6 in order; (1) turning on the transistors T1 and T5; (2) turning on the transistors T1 and T6; (3) turning on the transistors T2 and T6; (4) turning on the transistors T2 and T4; (5) turning on the transistors T3 and T4; and (6) turning on the transistors T3 and T5.

Figure 4:
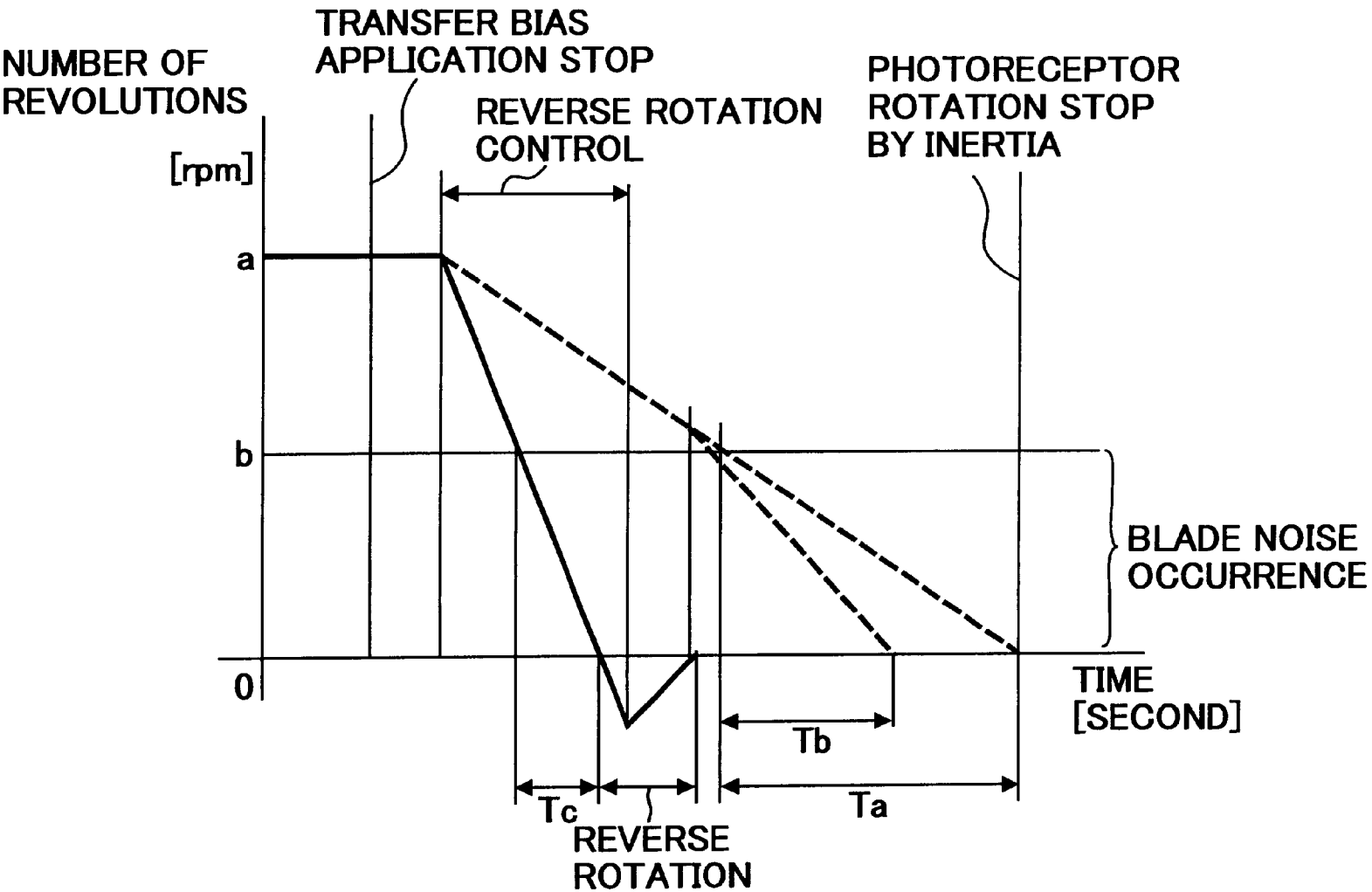
FIG. 4 is a view of a relationship between a number of revolutions (rpm) of a photoreceptor and a time until a rotation of the photoreceptor stops according to an embodiment of the present invention.

FIG. 4 is a view of a relationship between a number of revolutions (rpm) of the photoreceptor 11 and a time until a rotation of the photoreceptor 11 stops. As illustrated in FIG. 4, according to one embodiment of the present invention, after image forming operations are completed (i.e., after the microcomputer 23 controls the transfer device 12 to stop application of the transfer bias) with the photoreceptor 11 rotated at a number of revolutions "a" (rpm), the microcomputer 23 inputs an instruction to the photoreceptor driving control circuit 24 to supply the reverse current to the photoreceptor drive motor 25, and thereby the photoreceptor drive motor 25 is controlled to rotate in the reverse direction.

The reverse rotation of the photoreceptor drive motor 25 brakes the photoreceptor 11 and then rotates the photoreceptor 11 in the reverse direction. After the photoreceptor 11 rotates in the reverse direction for a short time, the microcomputer 23 inputs an instruction to the photoreceptor driving control circuit 24 to control the photoreceptor drive motor 25 to stop rotating the photoreceptor 11. Subsequently, the photoreceptor 11 further rotates in the reverse direction by inertia, and then stops. Hereinafter, the control of rotating the photoreceptor drive motor 25 in the reverse direction may be referred to as a "reverse rotation control of the photoreceptor drive motor 25". The reverse rotation control of the photoreceptor drive motor 25 corresponds to a rotation control of the photoreceptor 11.

In the copier employing the above-described reverse rotation control of the photoreceptor drive motor 25, because the photoreceptor 11 is not always in a braking condition, but is only in a braking condition for a short period of time, a wear of a transmission gear for driving the photoreceptor 11 is suppressed compared to the background image forming apparatus including the photoreceptor with the substance having a specific gravity of 0.5 or greater.

Figure 13:
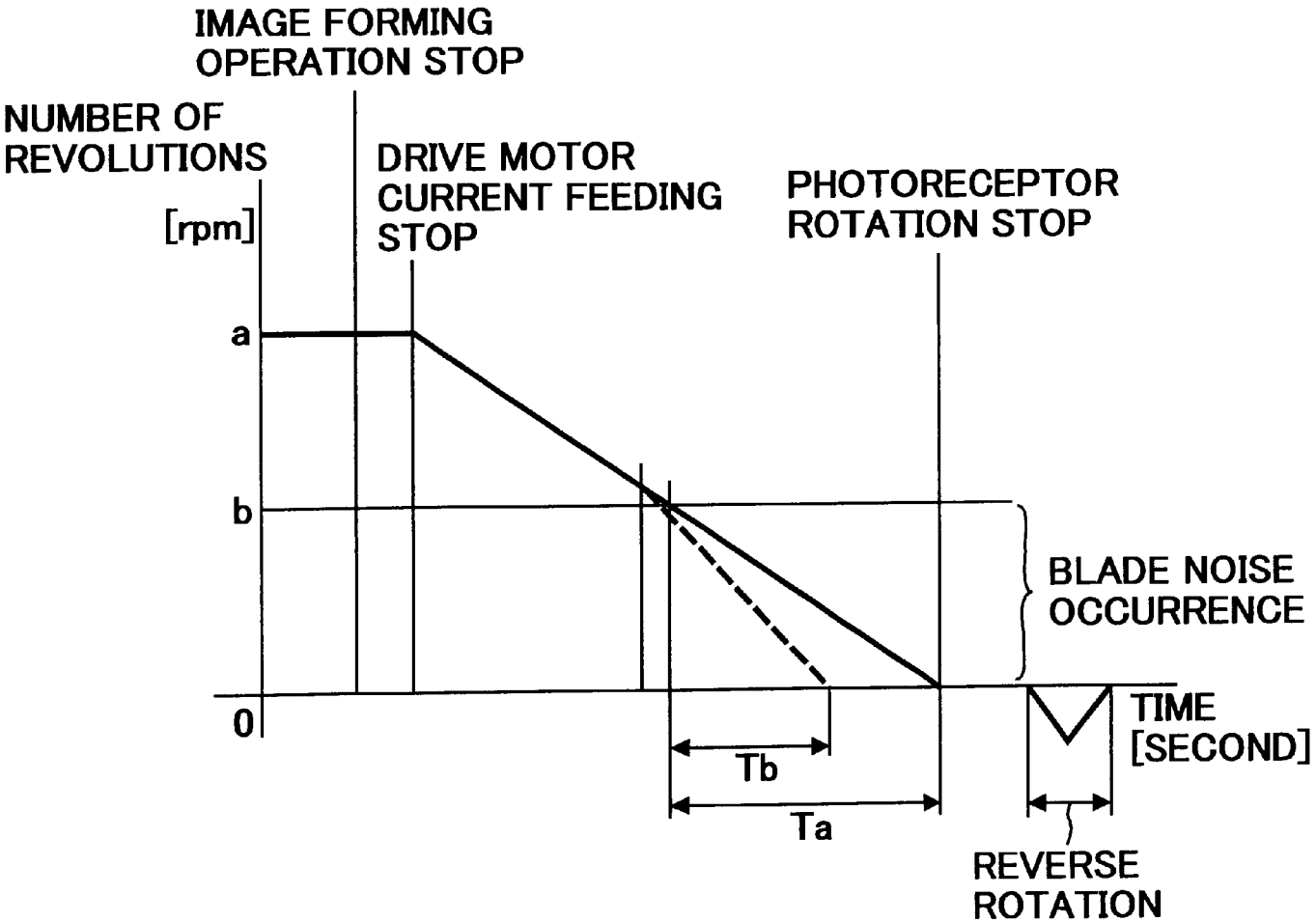
FIG. 13 BACKGROUND ART
FIG. 13 is a view of a relationship between a number of revolutions (rpm) of a photoreceptor and a time until a rotation of a photoreceptor stops according to a background art.

Further, in the above-described reverse rotation control of the photoreceptor drive motor 25, because the photoreceptor drive motor 25 is controlled to rotate in the reverse direction to brake the photoreceptor 11 before the rotation of the photoreceptor 11 stops, a rotation time of the photoreceptor 11 in a period between the number of revolutions "b" (rpm) and the number of revolutions "zero", in which a blade noise is likely to occur, is reduced to "Tc" (seconds) compared to the rotation time "Ta" (seconds) and "Tb" (seconds) in the background image forming apparatus illustrated in FIGS. 4 and 13. Consequently, the occurrence of blade noise is effectively prevented.

In addition, rotating the photoreceptor 11 in the reverse direction causes a foreign substance such as paper powder attached on the leading edge of the cleaning blade 15*a* to be removed therefrom. As a result, the useful life of the cleaning blade 15*a* is extended.

Moreover, the copier of this invention can employ an electric control device for controlling the photoreceptor drive motor 25 to rotate in the reverse direction in order to prevent occurrence of blade noise. Compared to the background image forming apparatus including the photoreceptor in which a control material is attached to an inner wall of the photoreceptor to prevent the occurrence of resonance noise between the photoreceptor and the cleaning blade, even if a relatively large sized photoreceptor is employed in the copier of the present invention, the cost for preventing the occurrence of blade noise becomes relatively low.

Although the photoreceptor 11 rotates at a low speed when the photoreceptor 11 rotates in the reverse direction, the blade noise is not likely to occur because the contact angle of the cleaning blade 15*a* relative to the photoreceptor 11 is different from that of the cleaning blade 15*a* relative to the photoreceptor 11 when the photoreceptor 11 rotates in the forward direction.

In the above-described embodiment of the rotation control of the photoreceptor 11 in FIG. 4, the photoreceptor drive motor 25 is controlled to rotate in the reverse direction immediately after the microcomputer 23 controls the transfer device 12 to stop the application of the transfer bias. However, when the photoreceptor drive motor 25 is switched to rotate in the reverse direction at the time of high rotational speed of the photoreceptor 11, a relatively large counter electromotive force is typically generated, so that an electric circuit may be damaged. Therefore, a high-priced electric circuit, through which a large electric current can pass, may be required.

Figure 5:
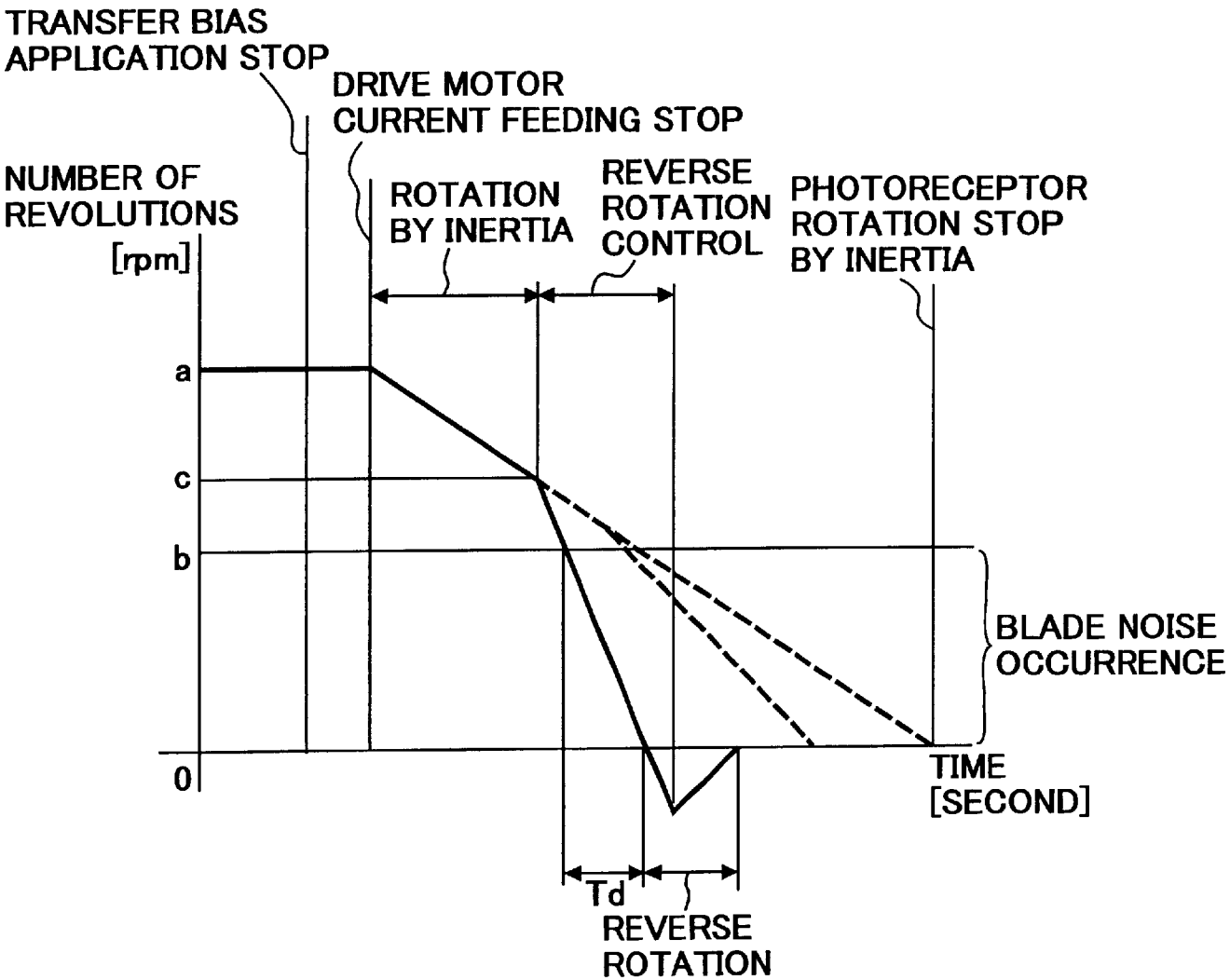
FIG. 5 is a view of a relationship between a number of revolutions (rpm) of the photoreceptor and a time until a rotation of the photoreceptor stops according to another embodiment of the present invention.

For the above-described reason, in another embodiment of the present invention illustrated in FIG. 5, after the microcomputer 23 controls the transfer device 12 to stop application of the transfer bias, the microcomputer 23 inputs an instruction to the photoreceptor driving control circuit 24 to stop feeding current to the photoreceptor drive motor 25. Thereafter, the photoreceptor 11 rotates by inertia for a short time. When the number of revolutions of the photoreceptor 11 decreases to a number of revolutions "c" (rpm), the photoreceptor drive motor 25 is controlled to rotate in the reverse direction to brake the photoreceptor 11 and then rotate the photoreceptor 11 in the reverse direction. In the above-described embodiment of the rotation control of the photoreceptor 11 illustrated in FIG. 5, the reverse rotation control of the photoreceptor drive motor 25 is started when the photoreceptor 11 rotates at a lower speed (i.e., at the number of revolutions "c" (rpm)). In this condition, because a counter electromotive force is kept to be relatively small, a low-priced electric circuit, through which only a small electric current can pass, can be employed.

With regard to a timing of starting the reverse rotation control of the photoreceptor drive motor 25, the photoreceptor drive motor 25 is controlled to rotate in the reverse direction a predetermined time after the completion of image forming operations. For example, the microcomputer 23 controls the photoreceptor drive motor 25 to rotate in the reverse direction a predetermined time after stopping application of the transfer bias, and then the microcomputer 23 controls the photoreceptor drive motor 25 to stop rotating in the reverse direction a predetermined time after stopping application of the transfer bias.

In the above-described rotation control of the photoreceptor 11, a predetermined time from the stoppage of the application of the transfer bias until the photoreceptor 11 rotates at a number of revolutions (rpm) at which a blade noise is likely to occur can be pre-set in the microcomputer 23. By starting the reverse rotation control of the photoreceptor drive motor 25 the above-described predetermined time after stopping application of the transfer bias, a rotation time of the photoreceptor 11 in a period between the number of revolutions "b" (rpm) and the number of revolutions "zero", in which a blade noise is likely to occur, is reduced to "Td" (seconds). Consequently, the occurrence of blade noise is effectively prevented.

Further, a predetermined time from the stoppage of application of the transfer bias until when the photoreceptor 11 rotates at a number of revolutions (rpm) at which a foreign substance attached to the leading edge of the cleaning blade 15*a* is removed can be pre-set in the microcomputer 23. By stopping the reverse rotation control of the photoreceptor drive motor 25 the above-described predetermined time after stopping application of the transfer bias, the foreign substance attached to the leading edge of the cleaning blade 15*a* is surely removed therefrom.

Further, undue reverse rotations of the photoreceptor 11 may curl-up the sealing member 14, which prevents the removed toner from leaking from the photoreceptor cleaning device 15. By stopping the reverse rotation control of the photoreceptor drive motor 25 the above-described predetermined time after stopping application of the transfer bias, such a curling-up of the sealing member 14 is obviated.

At the beginning of use of the cleaning blade 15*a,* the braking force of the cleaning blade 15*a* against the photoreceptor 11 is strong because the cleaning blade 15*a* does not creep and the leading edge of the cleaning blade 15*a* does not abrade. For this reason, as illustrated by a dotted line in FIG. 6, the photoreceptor 11 rotating at the number of revolutions "a" (rpm) in the forward direction is controlled to rotate at a number of revolutions "d" (rpm) in the reverse direction for "t2" seconds.

Figure 6:
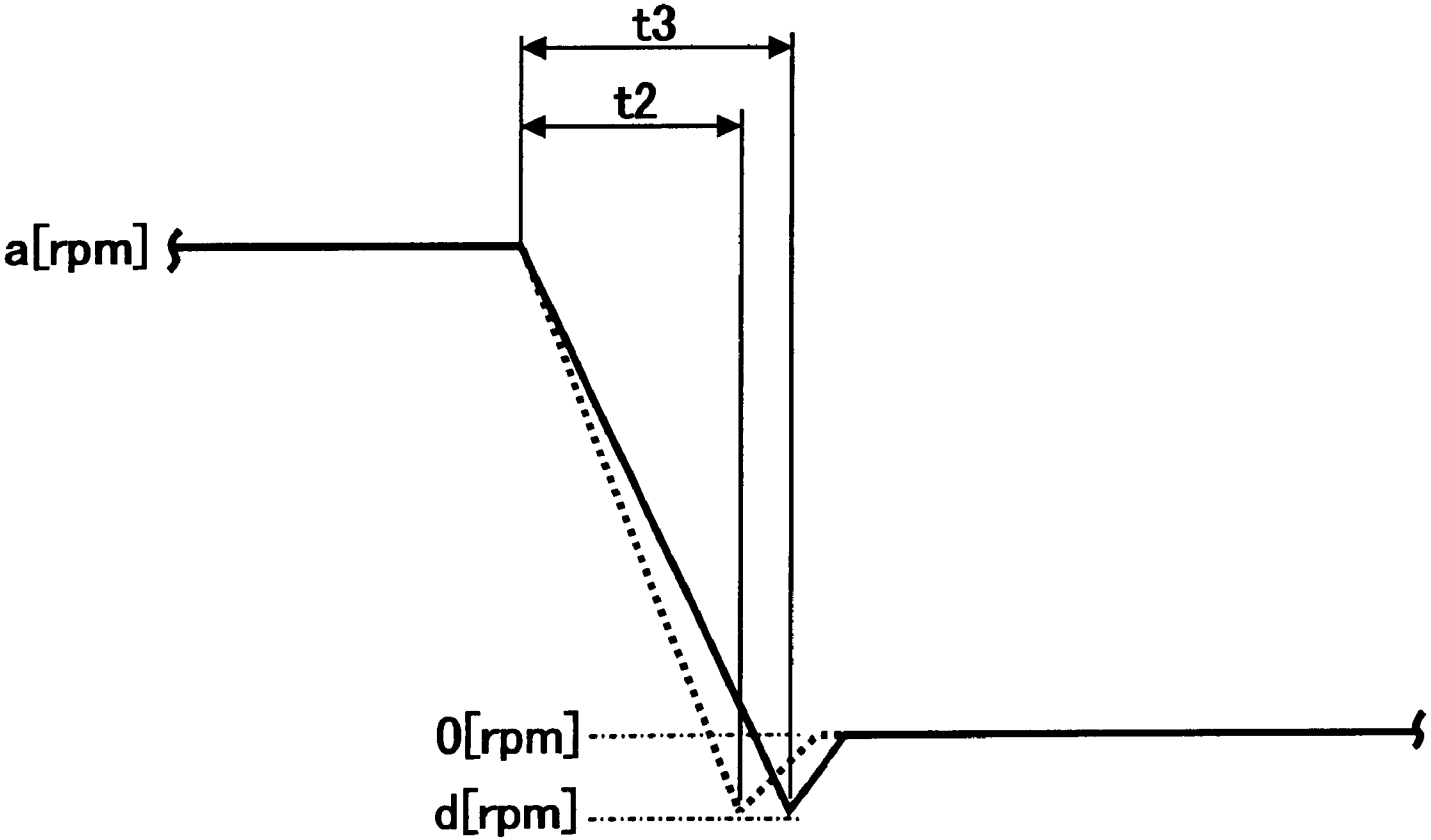
FIG. 6 is a view of a relationship between a number of revolutions (rpm) of the photoreceptor and a timing according to an example of the present invention.

On the other hand, when the cleaning blade 15*a* has been used for a long time, the braking force of the cleaning blade 15*a* against the photoreceptor 11 is relatively small due to the creep of the cleaning blade 15*a* and the abrasion of the leading edge of the cleaning blade 15*a.* For this reason, as illustrated by a solid line in FIG. 6, the photoreceptor 11 rotating at the number of revolutions "a" (rpm) in the forward direction is controlled to rotate at the number of revolutions "d" (rpm) in the reverse direction for "t3" seconds. In this case, if the reverse rotation control of the photoreceptor drive motor 25 has been performed for "t2" seconds, the photoreceptor 11 does not rotate in the reverse direction. As a result, the foreign substance attached to the leading edge of the cleaning blade 15*a* is not removed therefrom.

Figure 7:
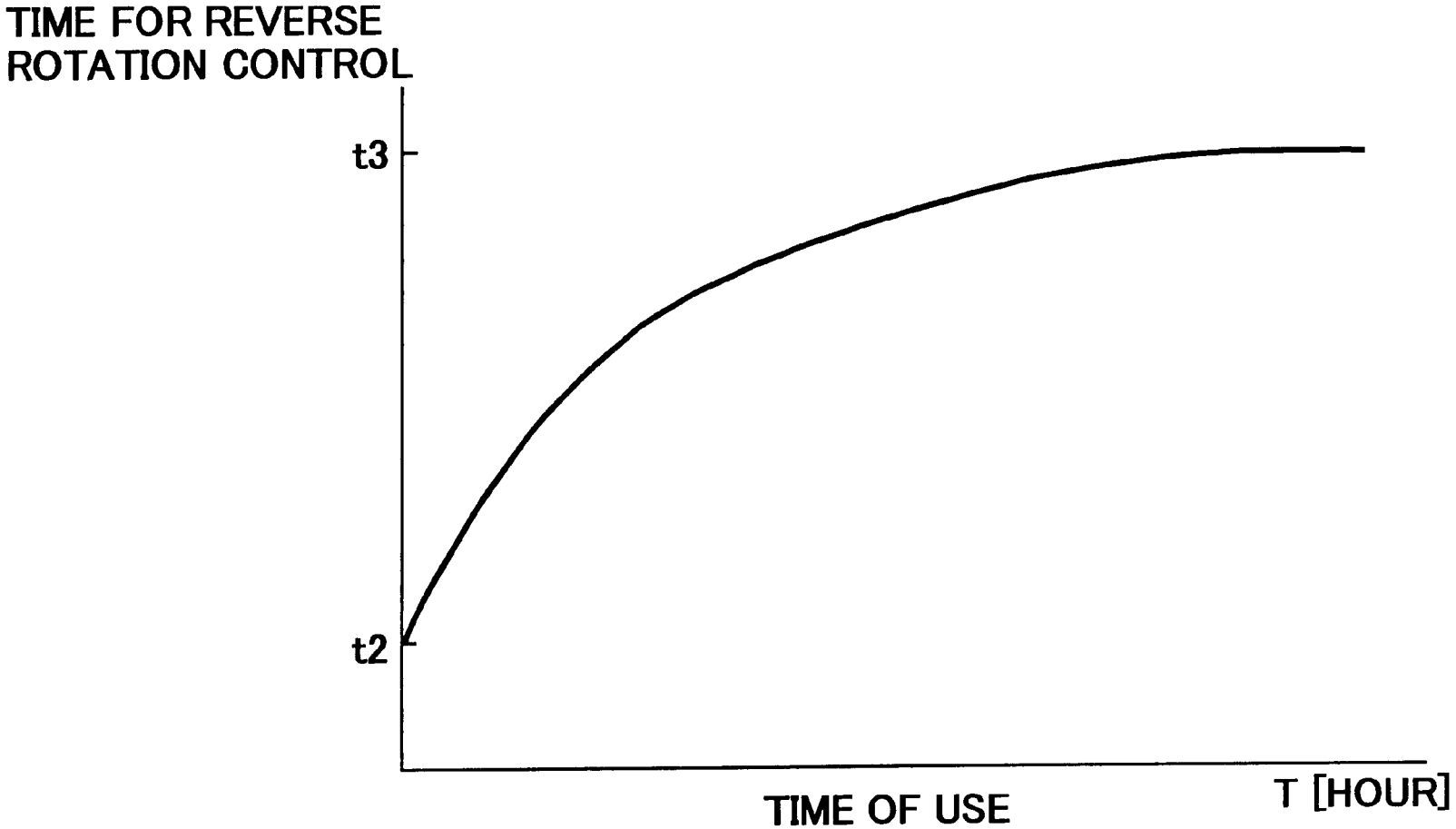
FIG. 7 is a graph showing a relationship between a time of using a cleaning blade and a time for reverse rotation control of a photoreceptor drive motor according to the example of FIG. 6.

FIG. 7 is a graph showing a relationship between a time of use of the cleaning blade 15*a* and a time for reverse rotation control of the photoreceptor drive motor 25 according to the example illustrated in FIG. 6.

Figure 8:
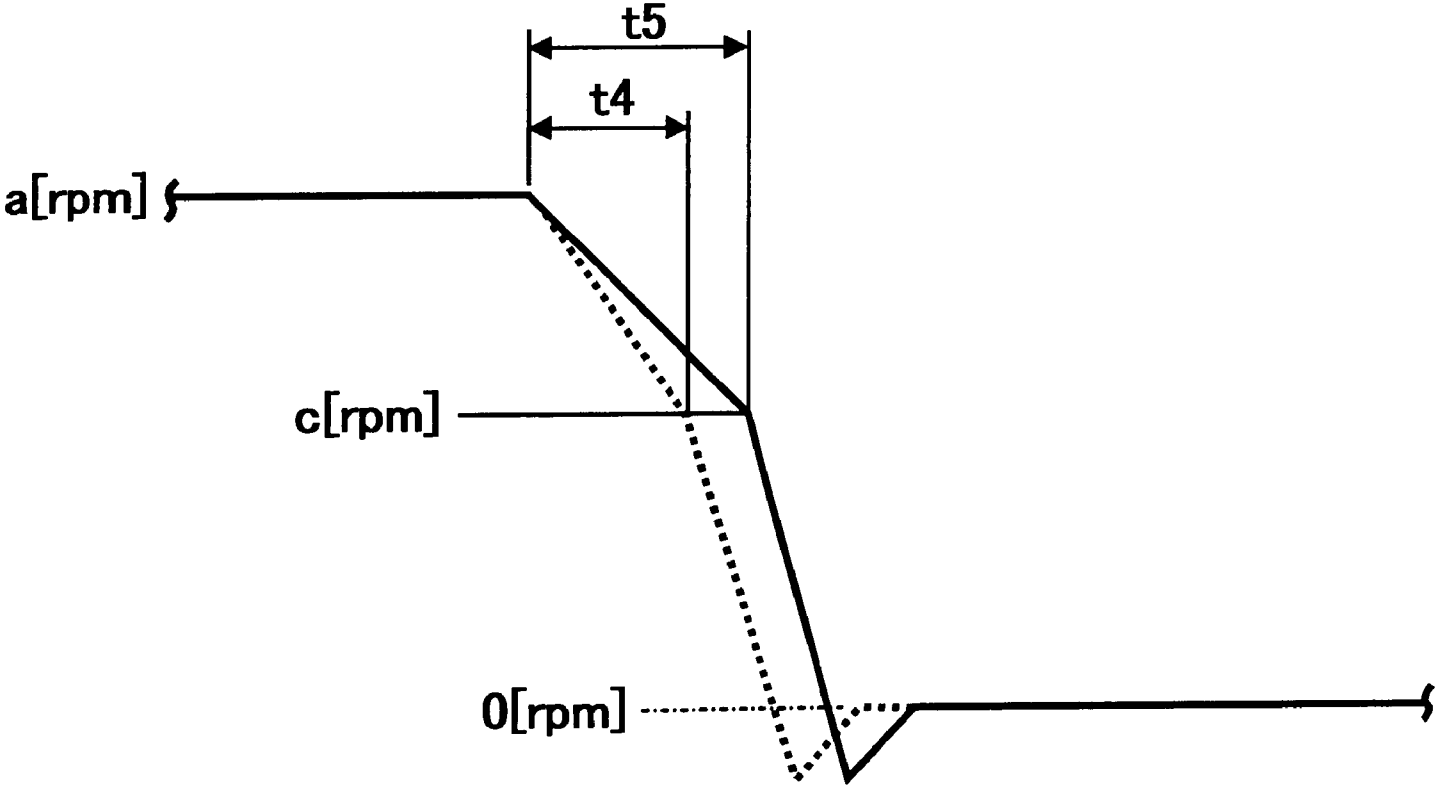
FIG. 8 is a view of a relationship between a number of revolutions (rpm) of the photoreceptor and a timing according to another example of the present invention.

In an example illustrated in FIG. 8, the photoreceptor 11 rotates by inertia until the photoreceptor 11 rotates at the number of revolutions "c" (rpm). At the beginning of use of the cleaning blade 15*a,* the reverse rotation control of the photoreceptor drive motor 25 can be started after the photoreceptor 11 rotates by inertia for "t4" seconds as illustrated by the dotted line in FIG. 8.

Figure 9:
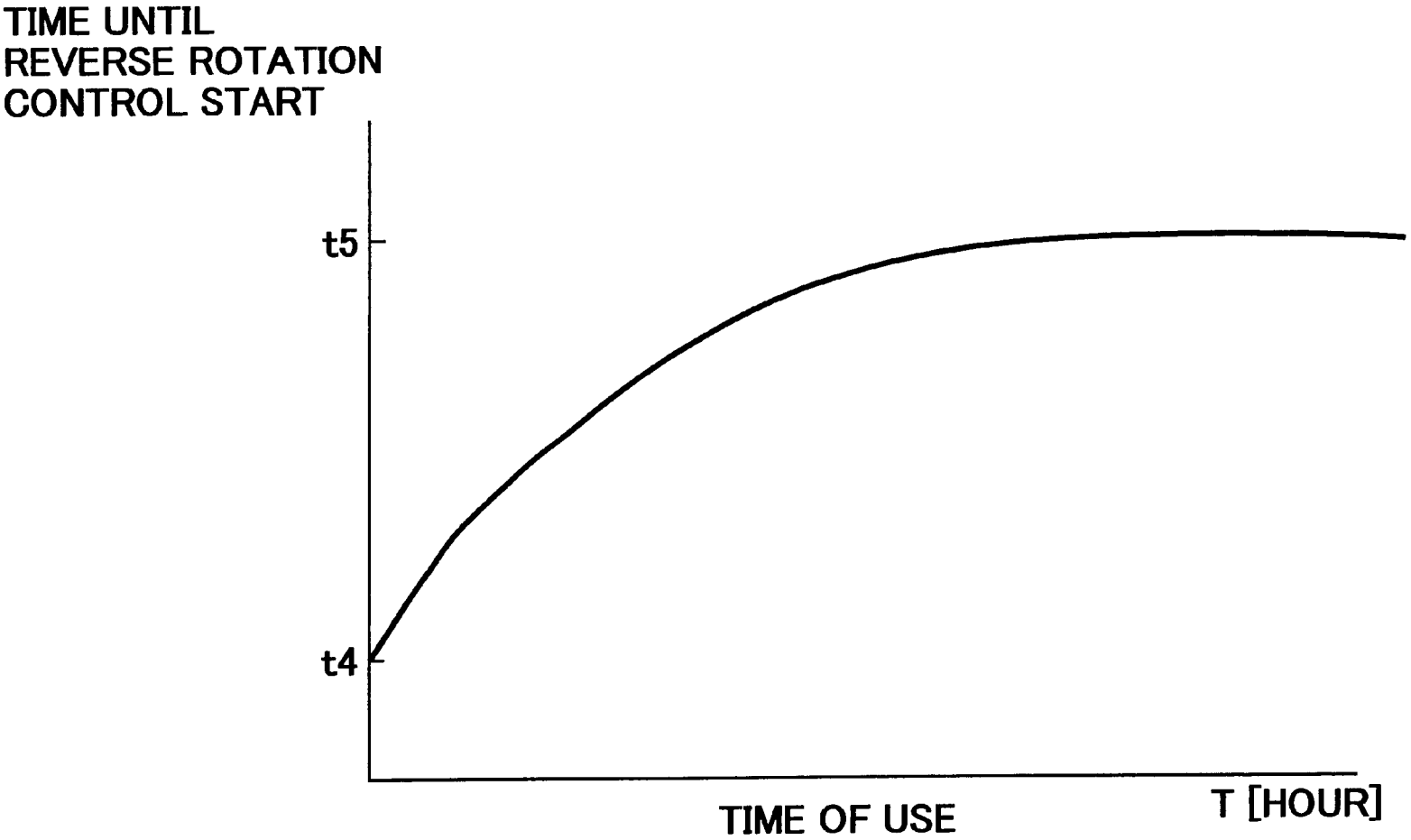
FIG. 9 is a graph showing a relationship between a time of using the cleaning blade and a time for reverse rotation control of the photoreceptor drive motor according to another example of FIG. 8.

When the cleaning blade 15*a* is used for a long time, it takes about "t5" seconds to start the reverse rotation control of the photoreceptor drive motor 25 as illustrated by a solid line in FIG. 8. FIG. 9 is a graph showing a relationship between a time of use of the cleaning blade 15*a* and a time until a start of the reverse rotation control of the photoreceptor drive motor 25 according to the example illustrated in FIG. 8.

Thus, the above-described "t2" through "t5" seconds illustrated in FIGS. 6 and 8 may be set according to the time of use of the cleaning blade 15*a*. The time of use of the cleaning blade 15*a* is measured by a timer in the microcomputer 23. When the cleaning blade 15*a* is replaced with a new one, the timer is reset.

For example, when the time of use of the cleaning blade 15*a* measured by the timer is zero hours, the "t2" in FIG. 6 is 0.4 seconds, and the "t4" in FIG. 8 is 0.15 seconds. When the time of use of the cleaning blade 15*a* measured by the timer is 100 hours, the "t3" in FIG. 6 is 0.6 seconds, and the "t5" in FIG. 8 is 0.2 seconds.

In the above-described example illustrated in FIG. 8, the reverse rotation control of the photoreceptor drive motor 25 is started according to the time of use of the cleaning blade 15*a* just before the photoreceptor 11 rotates at the number of revolutions (rpm) at which the blade noise is likely to occur, i.e., at which the counter electromotive force caused by the reverse rotation control of the photoreceptor drive motor 25 does not affect an electric circuit. Thereby, a rotation time of the photoreceptor 11 in a period of the number of revolutions (rpm), at which a blade noise is likely to occur, is reduced. Consequently, the occurrence of blade noise is effectively prevented. In addition, the foreign substance attached to the leading edge of the cleaning blade 15*a* is surely removed according to the time of use of the cleaning blade 15*a*.

Figure 10:
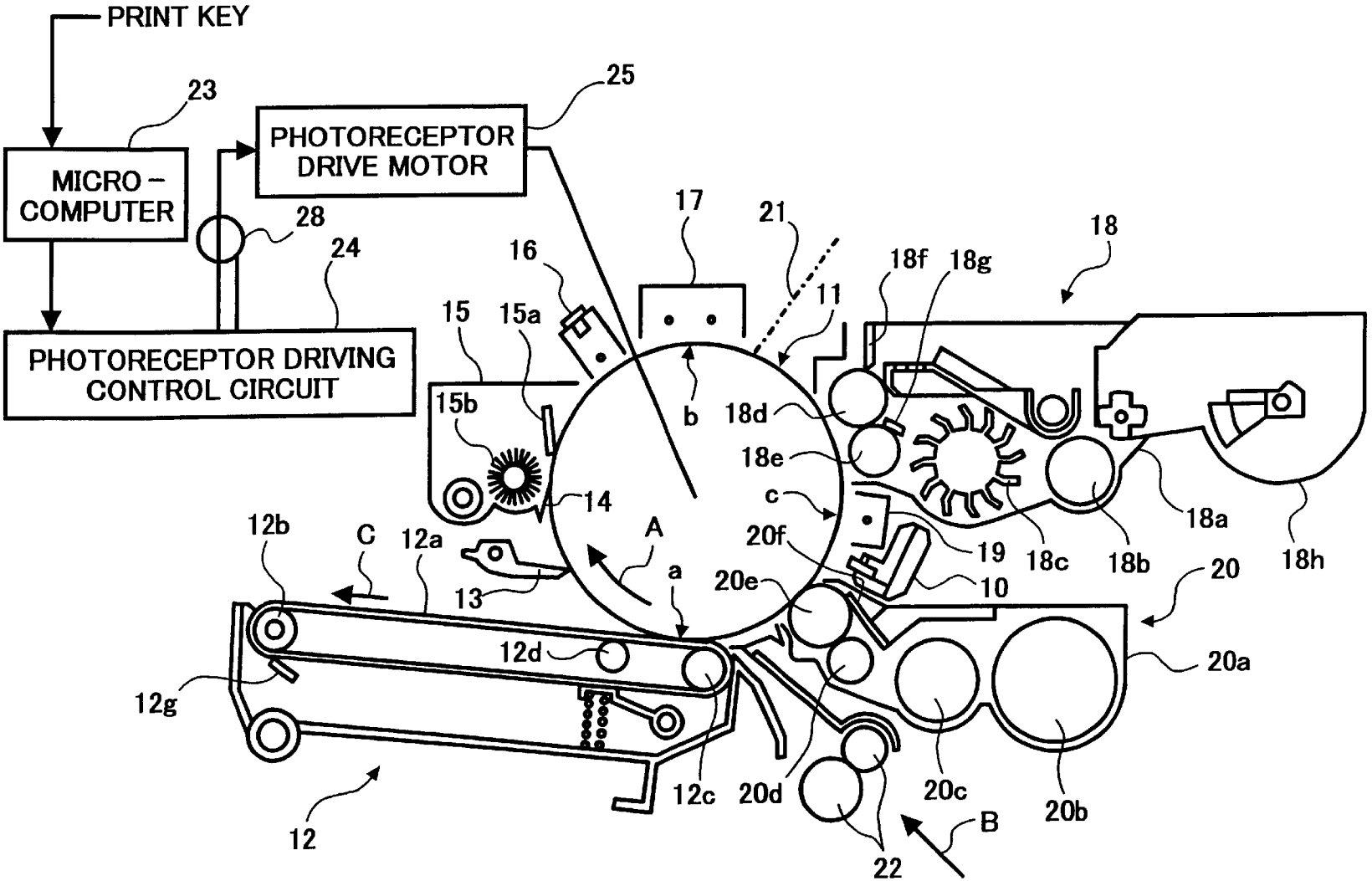
FIG. 10 is a schematic view of a two-color copier including a revolution number measuring device according to another embodiment of the present invention.

A time for reaching the number of revolutions "c" (rpm) of the photoreceptor 11 at which the reverse rotation control of the photoreceptor drive motor 25 is started changes according to the load on the photoreceptor 11. For this reason, as illustrated in FIG. 10, a revolution number measuring device 28 such as an encoder may be provided in the copier to measure the number of revolutions (rpm) of the photoreceptor 11. When the number of revolutions (rpm) of the photoreceptor 11 measured by the revolution number measuring device 28 reaches a predetermined number of revolutions (rpm) at which the blade noise is likely to occur, the reverse rotation control of the photoreceptor drive motor 25 may be started in accordance with an instruction from the microcomputer 23 while suppressing the counter electromotive force.

With the above-described rotation control of the photoreceptor 11 by use of the revolution number measuring device 28, a rotation time of the photoreceptor 11 in a period of the number of revolutions (rpm), at which a blade noise is likely to occur, is reduced. As a result, the occurrence of blade noise is effectively prevented.

The construction of the copier of FIG. 10 is substantially the same as that of the copier of FIG. 1 with the exception of the rotation number measuring device 28. For the sake of clarity, members of the copier of FIG. 10 having substantially the same functions as those used in the copier of FIG. 1 are designated with the same reference characters and their descriptions are omitted.

Further, when the photoreceptor 11 rotates at a predetermined number of revolutions (rpm) after the current feeding to the photoreceptor drive motor 25 is stopped, the reverse rotation control of the photoreceptor drive motor 25 is completed in accordance with the instruction from the microcomputer 23. Specifically, the number of revolutions (rpm) of the photoreceptor 11 at which the foreign substance attached to the leading edge of the cleaning blade 15*a* can be removed therefrom can be preset in the microcomputer 23. When the number of revolutions (rpm) of the photoreceptor 11 reaches the predetermined number of revolutions preset in the microcomputer 23, the microcomputer 23 controls the photoreceptor drive motor 25 to stop rotating the photoreceptor 11. Thereby, the foreign substance attached to the leading edge of the cleaning blade 15*a* is surely removed therefrom. In addition, a curling-up of the sealing member 14 due to undue reverse rotations of the photoreceptor 11 is obviated.

Figure 11:
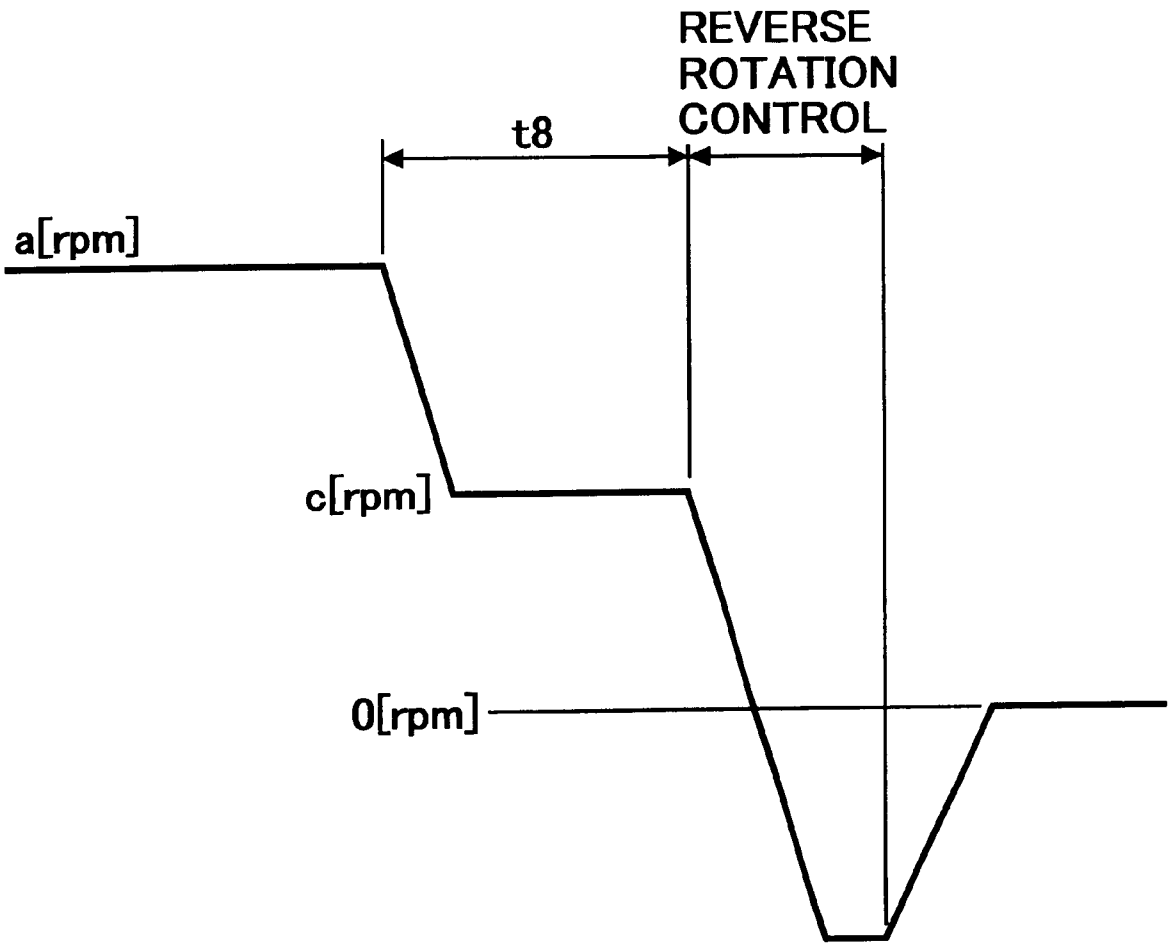
FIG. 11 is a view of a relationship between a number of revolutions (rpm) of the photoreceptor and a timing according to another example of the present invention.

As an alternative example, the photoreceptor driving control circuit 24 may control the photoreceptor drive motor 25 by a Pulse Width Modulation method in accordance with instructions from the microcomputer 23. As illustrated in FIG. 11, when the number of revolutions (rpm) of the photoreceptor 11 is decreased from the number of revolutions "a" (rpm) to the number of revolutions "c" (rpm) by the Pulse Width Modulation method, the microcomputer 23 inputs an instruction to the photoreceptor driving control circuit 24 to control the photoreceptor drive motor 25 to rotate in the reverse direction.

In the above-described rotation control of the photoreceptor 11 employing the Pulse Width Modulation method, an accurate reverse rotation control of the photoreceptor drive motor 25 can be simply performed without requiring the above-described revolution number measuring device 28. In this case, as illustrated in FIG. 11, it takes about "8" seconds to settle the number of revolutions (rpm) of the photoreceptor 11 at the number of revolutions "c" (rpm) by the Pulse Width Modulation method.

The number of revolutions "c" (rpm) of the photoreceptor 11 may be preferably set in a range of about 0.1 to 14.2 (rpm). By setting the number of revolutions "c" (rpm) as above and performing the reverse rotation control of the photoreceptor drive motor 25, the occurrence of the blade noise is prevented and the foreign substance attached to the leading edge of the cleaning blade 15*a* is removed.

The microcomputer 23 may control the photoreceptor drive motor 25 to intermittently rotate in the reverse direction. In this case, the reverse rotation control of the photoreceptor drive motor 25 is intermittently repeated while preventing a high counter electromotive force from generating at the photoreceptor drive motor 25. The above-described intermittent reverse rotation control of the photoreceptor drive motor 25 can be started immediately after stopping application of the transfer bias. With the intermittent reverse rotation control of the photoreceptor drive motor 25, the occurrence of the blade noise is surely prevented, and the foreign substance attached to the leading edge of the cleaning blade 15*a* is removed.

Further, in the intermittent reverse rotation control of the photoreceptor drive motor 25, a period of time the photoreceptor drive motor 25 rotates in the reverse direction may be gradually increased.

Figure 12:
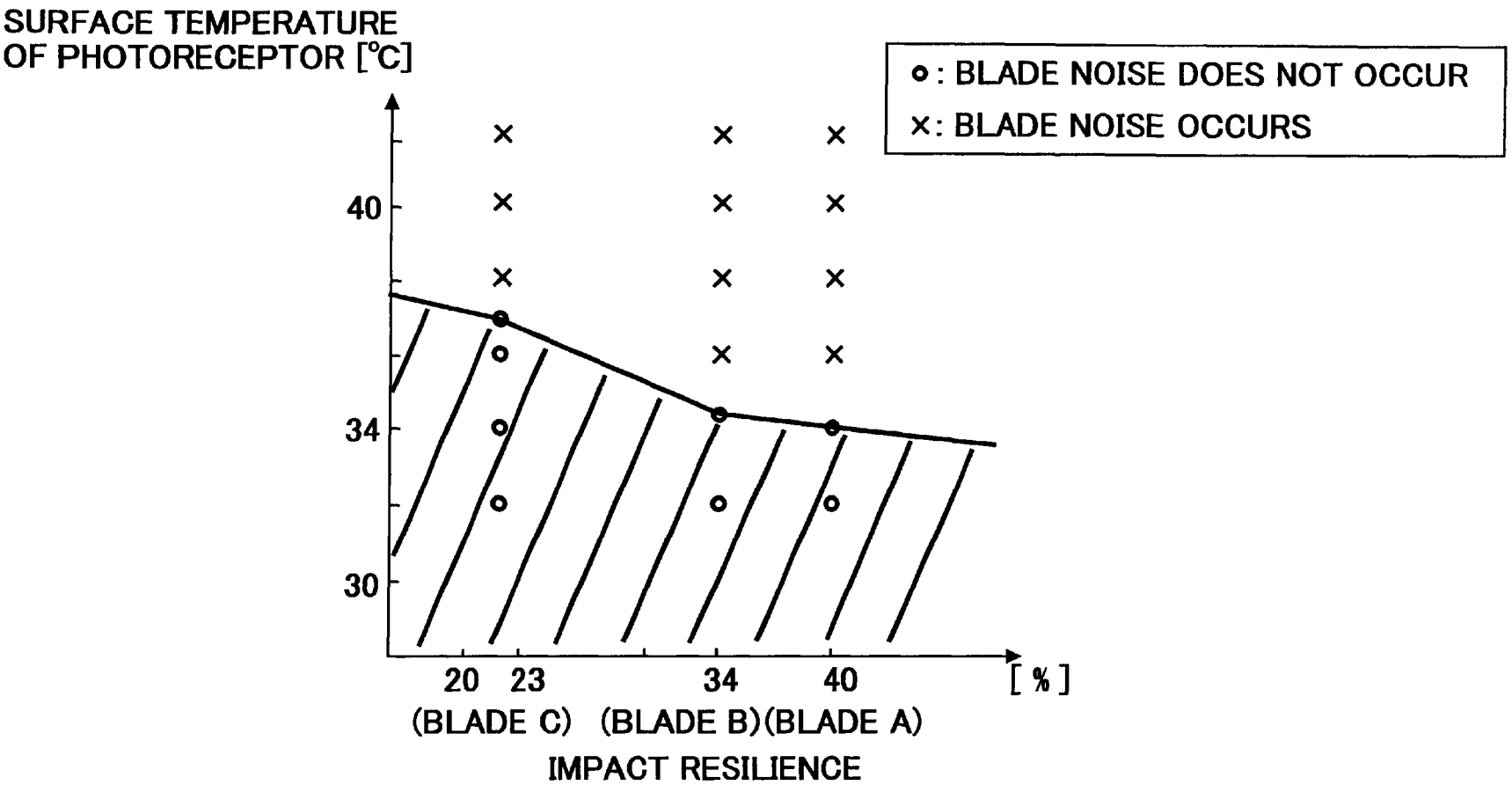
FIG. 12 is a graph showing a relationship between a surface temperature of the photoreceptor, an impact resilience of the cleaning blade, and an occurrence of blade noise.

FIG. 12 is a graph showing a relationship between a surface temperature of the photoreceptor 11, an impact resilience of the cleaning blade 15*a*, and an occurrence of the blade noise. FIG. 12 shows that the blade noise is likely to occur as the surface temperature of the photoreceptor 11 increases. Therefore, when the surface temperature of the photoreceptor 11 equals or exceeds a predetermined temperature, the microcomputer 23 controls the photoreceptor drive motor 25 to rotate in the reverse direction. Specifically, a reference temperature corresponding to the occurrence of the blade noise can be preset in the microcomputer 23. Only when the surface temperature of the photoreceptor 11 reaches the reference temperature, the reverse rotation control of the photoreceptor drive motor 25 is started.

Further, FIG. 12 shows that the blade noise is not likely to occur as the impact resilience of the cleaning blade 15*a* is lowered. So, the above-described reference temperature is changed according to the impact resilience of the cleaning blade 15*a*. The reverse rotation control of the photoreceptor drive motor 25 is started at an adequate timing when the blade noise is likely to occur, considering the surface temperature of the photoreceptor 11 and the impact resilience of the cleaning blade 15*a*. In the above-described rotation control of the photoreceptor 11, because the photoreceptor 11 is efficiently in a braking condition, a wear of a transmission gear for driving the photoreceptor 11 caused by unnecessary braking is prevented.

As described above, the present invention can be applied to an image forming apparatus such as the copier illustrated in FIGS. 1 and 10. In the copier of FIGS. 1 and 10, the toner image formed on the surface of the photoreceptor 11 is directly transferred to a transfer material such as a transfer sheet, an overhead transparency film, etc. After the toner image is transferred to the transfer material, the cleaning blade 15*a* of the photoreceptor cleaning device 15 removes the residual toner from the photoreceptor 11.

As one non-limiting alternative, the present invention may be applied to an image forming apparatus in which a toner image formed on a surface of a photoreceptor is transferred to a drum or belt shaped intermediate transfer member, and then the toner image on the intermediate transfer member is transferred to a transfer material such as a transfer sheet.

In the image forming apparatus employing the intermediate transfer member, the rotation control of the photoreceptor 11 of the present invention can be applied to a rotation control of the intermediate transfer member to prevent an occurrence of blade noise between the intermediate transfer member and a cleaning blade which removes residual toner from the intermediate transfer member.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-212134 filed in the Japanese Patent Office on Jul. 13, 2000, Japanese Patent Application No. 2000-391992 filed in the Japanese Patent Office on Dec. 25, 2000, and Japanese Patent Application No. 2001-167689 filed in the Japanese Patent Office on Jun. 4, 2001, the entire contents of each of which are hereby incorporated herein by reference.

What is claimed as new and is desired to be secured by Letters Patent of the United States is:

1. A controller to control an image forming apparatus including a rotatable image bearing member configured to bear a toner image, a transfer device configured to transfer the toner image from the image bearing member to a transfer material by applying a transfer bias to the transfer material, a cleaning device configured to remove residual toner from the image bearing member by a cleaning blade, and an image bearing member drive motor configured to rotate in a forward direction and a reverse direction to drive the image bearing member to rotate in a forward direction and a reverse direction, comprising:

a control device configured to control the image bearing member drive motor to rotate in the reverse direction to brake the image bearing member and to then rotate the image bearing member in the reverse direction a predetermined time after controlling the transfer device to stop application of the transfer bias, and to control the image bearing member drive motor to stop rotating the image bearing member after the image bearing member starts rotating in the reverse direction.

2. The controller according to claim 1, wherein the control device is further configured to control the image bearing member drive motor to rotate in the reverse direction a predetermined time after stopping application of the transfer bias.

3. The controller according to claim 1, wherein the control device is further configured to control the image bearing member drive motor to stop rotating in the reverse direction a predetermined time after stopping application of the transfer bias.

4. A controller to control an image forming apparatus including a rotatable image bearing member configured to bear a toner image, a transfer device configured to transfer the toner image from the image bearing member to a transfer material by applying a transfer bias to the transfer material, a cleaning device configured to remove residual toner from the image bearing member by a cleaning blade, and an image bearing member drive motor configured to rotate in a forward direction and a reverse direction to drive the image bearing member to rotate in a forward direction and a reverse direction, comprising:

a control device configured to control the image bearing member drive motor to rotate in the reverse direction to brake the image bearing member and to then rotate the image bearing member in the reverse direction after controlling the transfer device to stop application of the transfer bias, and to control the image bearing member drive motor to stop rotating the image bearing member after the image bearing member starts rotating in the reverse direction, wherein the control device is further configured to control the image bearing member drive motor to rotate in the reverse direction a predetermined time after stopping application of the transfer bias, and wherein the predetermined time changes according to a time of use of the cleaning blade.

5. A controller to control an image forming apparatus including a rotatable image bearing member configured to bear a toner image, a transfer device configured to transfer the toner image from the image bearing member to a transfer material by applying a transfer bias to the transfer material, a cleaning device configured to remove residual toner from the image bearing member by a cleaning blade, and an image bearing member drive motor configured to rotate in a forward direction and a reverse direction to drive the image bearing member to rotate in a forward direction and a reverse direction, comprising:

a control device configured to control the image bearing member drive motor to rotate in the reverse direction to brake the image bearing member and to then rotate the image bearing member in the reverse direction a predetermined time after controlling the transfer device to stop application of the transfer bias, and to control the image bearing member drive motor to stop rotating the image bearing member after the image bearing member starts rotating in the reverse direction, wherein the control device is further configured to control the image bearing member drive motor to stop rotating in the reverse direction a predetermined time after stopping application of the transfer bias, and wherein the predetermined time changes according to a time of use of the cleaning blade.

6. The controller according to claim 1, wherein the control device is further configured to control the image bearing member drive motor to stop rotating the image bearing member after controlling the transfer device to stop application of the transfer bias, and when the image bearing member rotates at a predetermined number of revolutions (rpm), the control device controls the image bearing member drive motor to rotate in the reverse direction.

7. The controller according to claim 6, wherein after rotating the image bearing member in the reverse direction, when the image bearing member rotates at a predetermined number of revolutions (rpm), the control device is further configured to control the image bearing member drive motor to stop rotating in the reverse direction.

8. The controller according to claim 1, wherein the control device is further configured to control the image bearing member drive motor by a pulse width modulation and when the image bearing member rotates at a predetermined number of revolutions (rpm), the control device controls the image bearing member drive motor to rotate in the reverse direction.

9. The controller according to claim 6, wherein the predetermined number of revolutions (rpm) is set in a range from about 0.1 to 14.2.

10. The controller according to claim 8, wherein the predetermined number of revolutions (rpm) is set in a range from about 0.1 to 14.2.

11. The controller according to claim 1, wherein the control device is further configured to control the image bearing member drive motor to intermittently rotate in the reverse direction.

12. The controller according to claim 11, wherein the control device is further configured to control the image bearing member drive motor to intermittently rotate in the reverse direction such that a period of time the image bearing member drive motor rotates in the reverse direction is gradually increased.

13. A controller to control an image forming apparatus including a rotatable image bearing member configured to bear a toner image, a transfer device configured to transfer the toner image from the image bearing member to a transfer material by applying a transfer bias to the transfer material, a cleaning device configured to remove residual toner from the image bearing member by a cleaning blade, and an image bearing member drive motor configured to rotate in a forward direction and a reverse direction to drive the image bearing member to rotate in a forward direction and a reverse direction, comprising:

a control device configured to control the image bearing member drive motor to rotate in the reverse direction to brake the image bearing member and to then rotate the image bearing member in the reverse direction after controlling the transfer device to stop application of the transfer bias, and to control the image bearing member drive motor to stop rotating the image bearing member after the image bearing member starts rotating in the reverse direction, wherein when a surface temperature of the image bearing member equals or exceeds a predetermined reference temperature, the control device controls the image bearing member drive motor to rotate in the reverse direction.

14. The controller according to claim 13, wherein the reference temperature changes according to impact resilience of the cleaning blade.

15. An image forming apparatus comprising:

a rotatable image bearing member configured to bear a toner image;

a transfer device configured to transfer the toner image from the image bearing member to a transfer material by applying a transfer bias to the transfer material;

a cleaning blade configured to remove residual toner from the image bearing member;

an image bearing member drive motor configured to rotate in a forward direction and a reverse direction to drive the image bearing member to rotate in a forward direction and a reverse direction; and a control device configured to control the image bearing member drive motor to rotate in the reverse direction to brake the image bearing member and then rotate the image bearing member in the reverse direction a predetermined time after controlling the transfer device to stop application of the transfer bias, and to control the image bearing member drive motor to stop rotating the image bearing member after the image bearing member starts rotating in the reverse direction.

16. The image forming apparatus according to claim 15, wherein the control device is configured to control the image bearing member drive motor to rotate in the reverse direction a predetermined time after stopping application of the transfer bias.

17. The image forming apparatus according to claim 15, wherein the control device is further configured to control the image bearing member drive motor to stop rotating in the reverse direction a predetermined time after stopping application of the transfer bias.

18. An image forming apparatus comprising:

a rotatable image bearing member configured to bear a toner image;

transfer device configured to transfer the toner image from the image bearing member to a transfer material by applying a transfer bias to the transfer material;

a cleaning blade configured to remove residual toner from the image bearing member;

an image bearing member drive motor configured to rotate in a forward direction and a reverse direction to drive the image bearing member to rotate in a forward direction and a reverse direction; and a control device configured to control the image bearing member drive motor to rotate in the reverse direction to brake the image bearing member and then rotate the image bearing member in the reverse direction after controlling the transfer device to stop application of the transfer bias, and to control the image bearing member drive motor to stop rotating the image bearing member after the image bearing member starts rotating in the reverse direction, wherein the control device is configured to control the image bearing member drive motor to rotate in the reverse direction a predetermined time after stopping application of the transfer bias, and wherein the predetermined time changes according to a time of use of the cleaning blade.

19. An image forming apparatus comprising:

a rotatable image bearing member configured to bear a toner image;

a transfer device configured to transfer the toner image from the image bearing member to a transfer material by applying a transfer bias to the transfer material;

a cleaning blade configured to remove residual toner from the image bearing member;

an image bearing member drive motor configured to rotate in a forward direction and a reverse direction to drive the image bearing member to rotate in a forward direction and a reverse direction; and a control device configured to control the image bearing member drive motor to rotate in the reverse direction to brake the image bearing member and then rotate the image bearing member in the reverse direction after controlling the transfer device to stop application of the transfer bias, and to control the image bearing member drive motor to stop rotating the image bearing member after the image bearing member starts rotating in the reverse direction, wherein the control device is further configured to control the image bearing member drive motor to stop rotating in the reverse direction a predetermined time after stopping application of the transfer bias, and wherein the predetermined time changes according to a time of use of the cleaning blade.

20. The image forming apparatus according to claim 15, wherein the control device is further configured to control the image bearing member drive motor to stop rotating the image bearing member after controlling the transfer device to stop application of the transfer bias, and when the image bearing member rotates at a predetermined number of revolutions (rpm), the control device controls the image bearing member drive motor to rotate in the reverse direction.

21. The image forming apparatus according to claim 20, wherein after rotating the image bearing member in the reverse direction, when the image bearing member rotates at a predetermined number of revolutions (rpm), the control device controls the image bearing member drive motor to stop rotating in the reverse direction.

22. The image forming apparatus according to claim 15, wherein the control device is further configured to control the image bearing member drive motor by a pulse width modulation and when the image bearing member rotates at a predetermined number of revolutions (rpm), the control device controls the image bearing member drive motor to rotate in the reverse direction.

23. The image forming apparatus according to claim 20, wherein the predetermined number of revolutions (rpm) is set in a range from about 0.1 to 14.2.

24. The image forming apparatus according to claim 22, wherein the predetermined number of revolutions (rpm) is set in a range from about 0.1 to 14.2.

25. The image forming apparatus according to claim 15, wherein the control device is further configured to control the image bearing member drive motor to intermittently rotate in the reverse direction.

26. The image forming apparatus according to claim 25, wherein the control device is further configured to control the image bearing member drive motor to intermittently rotate in the reverse direction such that a period of time the image bearing member drive motor rotates in the reverse direction is gradually increased.

27. An image forming apparatus comprising:

a rotatable image bearing member configured to bear a toner image;

a transfer device configured to transfer the toner image from the image bearing member to a transfer material by applying a transfer bias to the transfer material;

a cleaning blade configured to remove residual toner from the image bearing member;

an image bearing member drive motor configured to rotate in a forward direction and a reverse direction to drive the image bearing member to rotate in a forward direction and a reverse direction; and a control device configured to control the image bearing member drive motor to rotate in the reverse direction to brake the image bearing member and then rotate the image bearing member in the reverse direction after controlling the transfer device to stop application of the transfer bias, and to control the image bearing member drive motor to stop rotating the image bearing member after the image bearing member starts rotating in the reverse direction, wherein when a surface temperature of the image bearing member equals or exceeds a predetermined reference temperature, the control device controls the image bearing member drive motor to rotate in the reverse direction.

28. The image forming apparatus according to claim 27, wherein the reference temperature changes according to impact resilience of the cleaning blade.

29. A method of forming an image in an image forming apparatus, comprising the steps of:

rotating an image bearing member to form an image thereupon;

applying a transfer bias to a transfer material to transfer a toner image on the image bearing member to the transfer material; and controlling an image bearing member drive motor to rotate in a reverse direction to brake the image bearing member and then rotate the image bearing member in the reverse direction a predetermined time after controlling a transfer device to stop application of the transfer bias, and to stop rotating the image bearing member after the image bearing member starts rotating in the reverse direction.

30. The method according to claim 29, wherein the step of controlling the image bearing member drive motor includes controlling the image bearing member drive motor to rotate in the reverse direction a predetermined time after stopping application of the transfer bias.

31. The method according to claim 29, wherein the step of controlling the image bearing member drive motor includes controlling the image bearing member drive motor to stop rotating in the reverse direction a predetermined time after stopping application of the transfer bias.

32. A method of forming an image in an image forming apparatus, comprising the steps of:

rotating an image bearing member to form an image thereupon;

applying a transfer bias to a transfer material to transfer a toner image on the image bearing member to the transfer material; and controlling an image bearing member drive motor to rotate in a reverse direction to brake the image bearing member and then rotate the image bearing member in the reverse direction after controlling a transfer device to stop application of the transfer bias, and to stop rotating the image bearing member after the image bearing member starts rotating in the reverse direction, wherein the step of controlling the image bearing member drive motor includes controlling the image bearing member drive motor to rotate in the reverse direction a predetermined time after stopping application of the transfer bias, and wherein the predetermined time changes according to a time of use of a cleaning blade.

33. A method of forming an image in an image forming apparatus, comprising the steps of:

rotating an image bearing member to form an image thereupon;

applying a transfer bias to a transfer material to transfer a toner image on the image bearing member to the transfer material; and controlling an image bearing member drive motor to rotate in a reverse direction to brake the image bearing member and then rotate the image bearing member in the reverse direction after controlling a transfer device to stop application of the transfer bias, and to stop rotating the image bearing member after the image bearing member starts rotating in the reverse direction, wherein the step of controlling the image bearing member drive motor includes controlling the image bearing member drive motor to stop rotating in the reverse direction a predetermined time after stopping application of the transfer bias, and wherein the predetermined time changes according to a time of use of a cleaning blade.

34. The method according to claim 29, wherein the step of controlling the image bearing member drive motor includes controlling the image bearing member drive motor to stop rotating the image bearing member after controlling the transfer device to stop application of the transfer bias, and controlling the image bearing member drive motor to rotate in the reverse direction when the image bearing member rotates at a predetermined number of revolutions (rpm).

35. The method according to claim 34, wherein the step of controlling the image bearing member drive motor further includes controlling the image bearing member drive motor to stop rotating in the reverse direction when the image bearing member rotates at a predetermined number of revolutions (rpm), after rotating the image bearing member in the reverse direction.

36. The method according to claim 29, wherein the step of controlling the image bearing member drive motor includes controlling the image bearing member drive motor by a pulse width modulation, and controlling the image bearing member drive motor to rotate in the reverse direction when the image bearing member rotates at a predetermined number of revolutions (rpm).

37. The method according to claim 34, wherein the predetermined number of revolutions (rpm) is set in a range from about 0.1 to 14.2.

38. The method according to claim 36, wherein the predetermined number of revolutions (rpm) is set in a range from about 0.1 to 14.2.

39. The method according to claim 29, wherein the step of controlling the image bearing member drive motor includes controlling the image bearing member drive motor to intermittently rotate in the reverse direction.

40. The method according to claim 39, wherein a period of time the image bearing member drive motor rotates in the reverse direction is gradually increased.

41. A method of forming an image in an image forming apparatus, comprising the steps of:

rotating an image bearing member to form an image thereupon;

applying a transfer bias to a transfer material to transfer a toner image on the image bearing member to the transfer material; and controlling an image bearing member drive motor to rotate in a reverse direction to brake the image bearing member and then rotate the image bearing member in the reverse direction after controlling a transfer device to stop application of the transfer bias, and to stop rotating the image bearing member after the image bearing member starts rotating in the reverse direction, wherein the step of controlling the image bearing member drive motor includes controlling the image bearing member drive motor to rotate in the reverse direction when a surface temperature of the image bearing member equals or exceeds a predetermined reference temperature.

42. The method according to claim 41, wherein the reference temperature changes according to impact resilience of a cleaning blade.

43. A computer program product which stores computer program instructions which when executed by a computer result in an image forming operation, comprising:

a first computer readable code for rotating an image bearing member to form an image thereupon;

a second computer readable code for applying a transfer bias to a transfer material to transfer a toner image on the image bearing member to the transfer material; and a third computer readable code for controlling an image bearing member drive motor to rotate in a reverse direction to brake the image bearing member and then rotate the image bearing member in the reverse direction a predetermined time after controlling a transfer device to stop application of the transfer bias, and to stop rotating the image bearing member after the image bearing member starts rotating in the reverse direction.

44. The computer program product according to claim 43, wherein the a third computer readable code further controls the image bearing member drive motor to rotate in the reverse direction a predetermined time after stopping application of the transfer bias.

45. The computer program product according to claim 43, wherein the third computer readable code further controls the image bearing member drive motor to stop rotating in the reverse direction a predetermined time after stopping application of the transfer bias.

46. A computer program product which stores computer program instructions which when executed by a computer result in an image forming operation, comprising:

a first computer readable code for rotating an image bearing member to form an image thereupon;

a second computer readable code for applying a transfer bias to a transfer material to transfer a toner image on the image bearing member to the transfer material; and a third computer readable code for controlling an image bearing member drive motor to rotate in a reverse direction to brake the image bearing member and then rotate the image bearing member in the reverse direction after controlling a transfer device to stop application of the transfer bias, and to stop rotating the image bearing member after the image bearing member starts rotating in the reverse direction, wherein the third computer readable code further controls the image bearing member drive motor to rotate in the reverse direction a predetermined time after stopping application of the transfer bias, and wherein the predetermined time changes according to a time of use of a cleaning blade.

47. A computer program product which stores computer program instructions which when executed by a computer result in an image forming operation, comprising:

a first computer readable code for rotating an image bearing member to form an image thereupon;

a second computer readable code for applying a transfer bias to a transfer material to transfer a toner image on the image bearing member to the transfer material; and a third computer readable code for controlling an image bearing member drive motor to rotate in a reverse direction to brake the image bearing member and then rotate the image bearing member in the reverse direction after controlling a transfer device to stop application of the transfer bias, and to stop rotating the image bearing member after the image bearing member starts rotating in the reverse direction, wherein the third computer readable code further controls the image bearing member drive motor to stop rotating in the reverse direction a predetermined time after stopping application of the transfer bias, and wherein the predetermined time changes according to a time of use of a cleaning blade.

48. The computer program product according to claim 43, wherein the third computer readable code further controls the image bearing member drive motor to stop rotating the image bearing member after controlling the transfer device to stop application of the transfer bias, and controls the image bearing member drive motor to rotate in the reverse direction when the image bearing member rotates at a predetermined number of revolutions (rpm).

49. The computer program product according to claim 48, wherein the third computer readable code further controls the image bearing member drive motor to stop rotating in the reverse direction when the image bearing member rotates at a predetermined number of revolutions (rpm), after rotating the image bearing member in the reverse direction.

50. The computer program product according to claim 43, wherein the third computer readable code further controls the image bearing member drive motor by a pulse width modulation, and controls the image bearing member drive motor to rotate in the reverse direction when the image bearing member rotates at a predetermined number of revolutions (rpm).

51. The computer program product according to claim 48, wherein the predetermined number of revolutions (rpm) is set in a range from about 0.1 to 14.2.

52. The computer program product according to claim 50, wherein the predetermined number of revolutions (rpm) is set in a range from about 0.1 to 14.2.

53. The computer program product according to claim 43, wherein the third computer readable code further controls the image bearing member drive motor to intermittently rotate in the reverse direction.

54. The computer program product according to claim 53, wherein a period of time the image bearing member drive motor rotates in the reverse direction is gradually increased.

55. A computer program product which stores computer program instructions which when executed by a computer result in an image forming operation, comprising:

a first computer readable code for rotating an image bearing member to form an image thereupon;

a second computer readable code for applying a transfer bias to a transfer material to transfer a toner image on the image bearing member to the transfer material; and a third computer readable code for controlling an image bearing member drive motor to rotate in a reverse direction to brake the image bearing member and then rotate the image bearing member in the reverse direction after controlling a transfer device to stop application of the transfer bias, and to stop rotating the image bearing member after the image bearing member starts rotating in the reverse direction, wherein the third computer readable code further controls the image bearing member drive motor to rotate in the reverse direction when a surface temperature of the image bearing member equals or exceeds a predetermined reference temperature.

56. The computer program product according to claim 55, wherein the reference temperature changes according to impact resilience of a cleaning blade.

57. An image forming apparatus comprising:

bearing means for bearing a toner image;

means for transferring the toner image from the bearing means to a transfer material;

means for removing residual toner from the bearing means;

means for rotating the bearing means in a forward direction and a reverse direction; and means for controlling the rotating means to rotate in the reverse direction to brake the bearing means and then rotate the bearing means in the reverse direction a predetermined time after controlling the transferring means to stop application of the transfer bias, and for controlling the rotating means to stop rotating the bearing means after the bearing means starts rotating in the reverse direction.

58. The image forming apparatus according to claim 57, wherein the controlling means further controls the rotating means to rotate in the reverse direction a predetermined time after stopping application of the transfer bias.

59. The image forming apparatus according to claim 57, wherein the controlling means further controls the rotating means to stop rotating in the reverse direction a predetermined time after stopping application of the transfer bias.

60. An image forming apparatus comprising:

bearing means for bearing a toner image;

means for transferring the toner image from the bearing means to a transfer material;

means for removing residual toner from the bearing means;

means for rotating the bearing means in a forward direction and a reverse direction; and means for controlling the rotating means to rotate in the reverse direction to brake the bearing means and then rotate the bearing means in the reverse direction a predetermined time after controlling the transferring means to stop application of the transfer bias, and for controlling the rotating means to stop rotating the bearing means after the bearing means starts rotating in the reverse direction, wherein the controlling means further controls the rotating means to rotate in the reverse direction a predetermined time after stopping application of the transfer bias, and wherein the predetermined time changes according to a time of use of the cleaning blade.

61. An image forming apparatus comprising:

bearing means for bearing a toner image;

means for transferring the toner image from the bearing means to a transfer material;

means for removing residual toner from the bearing means;

means for rotating the bearing means in a forward direction and a reverse direction; and means for controlling the rotating means to rotate in the reverse direction to brake the bearing means and then rotate the bearing means in the reverse direction a predetermined time after controlling the transferring means to stop application of the transfer bias, and for controlling the rotating means to stop rotating the bearing means after the bearing means starts rotating in the reverse direction, wherein the controlling means further controls the rotating means to stop rotating in the reverse direction a predetermined time after stopping application of the transfer bias, and wherein the predetermined time changes according to a time of use of the cleaning blade.

62. The image forming apparatus according to claim 57, wherein the controlling means further controls the rotating means to stop rotating the bearing means after controlling the transferring means to stop application of the transfer bias, and when the bearing means rotates at a predetermined number of revolutions (rpm), the controlling means controls the rotating means to rotate in the reverse direction.

63. The image forming apparatus according to claim 62, wherein after rotating the bearing means in the reverse direction, when the bearing means rotates at a predetermined number of revolutions (rpm), the controlling means controls the rotating means to stop rotating in the reverse direction.

64. The image forming apparatus according to claim 57, wherein the controlling means further controls the rotating means by a pulse width modulation and when the bearing means rotates at a predetermined number of revolutions (rpm), the controlling means controls the rotating means to rotate in the reverse direction.

65. The image forming apparatus according to claim 62, wherein the predetermined number of revolutions (rpm) is set in a range from about 0.1 to 14.2.

66. The image forming apparatus according to claim 64, wherein the predetermined number of revolutions (rpm) is set in a range from about 0.1 to 14.2.

67. The image forming apparatus according to claim 57, wherein the controlling means further controls the rotating means to intermittently rotate in the reverse direction.

68. The image forming apparatus according to claim 67, wherein the controlling means further controls the rotating means to intermittently rotate in the reverse direction such that a period of time the rotating means rotates in the reverse direction is gradually increased.

69. An image forming apparatus comprising:

bearing means for bearing a toner image;

means for transferring the toner image from the bearing means to a transfer material;

means for removing residual toner from the bearing means;

means for rotating the bearing means in a forward direction and a reverse direction; and means for controlling the rotating means to rotate in the reverse direction to brake the bearing means and then rotate the bearing means in the reverse direction a predetermined time after controlling the transferring means to stop application of the transfer bias, and for controlling the rotating means to stop rotating the bearing means after the bearing means starts rotating in the reverse direction, wherein when a surface temperature of the bearing means equals or exceeds a predetermined reference temperature, the controlling means controls the rotating means to rotate in the reverse direction.

70. The image forming apparatus according to claim 69, wherein the reference temperature changes according to impact resilience of the cleaning blade.

* * * * *